US009903155B1

(12) United States Patent
Wagner et al.

(10) Patent No.: US 9,903,155 B1
(45) Date of Patent: Feb. 27, 2018

(54) WINDOW BRACKETS FOR PROVIDING EFFICIENT REMOVAL OF WINDOW SCREENS

(71) Applicants: Anita Ann Wagner, Fort Mitchell, KY (US); Robert Joseph Wagner, Fort Mitchell, KY (US)

(72) Inventors: Anita Ann Wagner, Fort Mitchell, KY (US); Robert Joseph Wagner, Fort Mitchell, KY (US)

( * ) Notice: Subject to any disclaimer, the term of this patent is extended or adjusted under 35 U.S.C. 154(b) by 10 days.

(21) Appl. No.: 14/592,937

(22) Filed: Jan. 9, 2015

Related U.S. Application Data

(60) Provisional application No. 61/925,829, filed on Jan. 10, 2014.

(51) Int. Cl.

| | |
|---|---|
| ***E06B 9/323*** | (2006.01) |
| ***E06B 9/264*** | (2006.01) |
| ***E06B 9/266*** | (2006.01) |
| ***E06B 9/30*** | (2006.01) |
| ***E06B 9/52*** | (2006.01) |

(52) U.S. Cl.
CPC ..... *E06B 9/264* (2013.01); *E06B 9/266* (2013.01); *E06B 9/30* (2013.01); *E06B 9/52* (2013.01); *E06B 2009/527* (2013.01)

(58) Field of Classification Search
CPC ..... E06B 9/264; E06B 9/266; E06B 9/323; E06B 2009/527; E06B 3/5871
See application file for complete search history.

(56) References Cited

U.S. PATENT DOCUMENTS

| | | | | |
|---|---|---|---|---|
| 2,122,130 A * | 6/1938 | Dahnert | E06B 9/52 | 292/204 |
| 2,744,346 A * | 5/1956 | Auerbach-Levy | A47G 1/06 | 160/369 |
| 2,818,609 A * | 1/1958 | Nielsen | E06B 3/5871 | 49/316 |
| 3,222,839 A * | 12/1965 | Philpot | E04B 2/58 | 52/204.72 |
| 4,065,900 A * | 1/1978 | Eggert | E06B 3/28 | 52/476 |

(Continued)

OTHER PUBLICATIONS

Hunter Douglas, Installation Guide: Silhouette® and Nantucket Window Shadings, 2014, pp. 1-21.

(Continued)

*Primary Examiner* — Katherine W Mitchell
*Assistant Examiner* — Abe Massad
(74) *Attorney, Agent, or Firm* — Frost Brown Todd LLC

(57) ABSTRACT

A window system includes a window frame, a window screen, blinds, and a bracket operable to secure the blinds to the window frame. The bracket is selectively securable to an interior surface of the window frame. With the bracket secured to the window frame, the bracket is operable to couple with a headrail of the blinds to thereby secure the blinds to the window frame. In some versions of the bracket, the bracket may be collapsible between an open position and a closed position to thereby allow for removal of the window screen from the window frame with the bracket secured to the window frame. In other versions, the bracket may have a sufficiently low profile to thereby allow for removal of the window screen from the window frame with the bracket secured to the window frame.

12 Claims, 22 Drawing Sheets

(56) References Cited

U.S. PATENT DOCUMENTS

| | | | | |
|---|---|---|---|---|
| 4,187,643 | A * | 2/1980 | Sconzo | E06B 3/28 49/195 |
| 4,265,423 | A * | 5/1981 | Vecchiarelli | E06B 9/323 160/902 |
| 6,540,187 | B2 * | 4/2003 | Carter | E06B 9/323 160/178.1 R |
| 6,928,776 | B2 * | 8/2005 | Hornung | E06B 3/24 156/107 |
| 7,367,536 | B1 * | 5/2008 | Anderson | A47H 1/144 160/902 |
| 7,730,932 | B1 * | 6/2010 | Bauer | E06B 9/00 160/31 |
| 9,249,624 | B2 * | 2/2016 | Blair | E06B 9/32 |
| 2007/0089841 | A1 * | 4/2007 | Rossato | E06B 9/323 160/178.1 R |
| 2013/0153162 | A1 * | 6/2013 | Blair | E06B 9/68 160/310 |

OTHER PUBLICATIONS

Hunter Douglas, Installation Guide: Horizontal Blinds, 2014, pp. 1-18.

* cited by examiner

WINDOW BRACKETS FOR PROVIDING EFFICIENT REMOVAL OF WINDOW SCREENS

BACKGROUND

Headrails for window blinds may be mounted in a window opening by attachment either to the window frame, by an end mount to the inner walls of the window casing, or by an overhead mount to the upper wall of the casing or the ceiling adjacent to the window. Brackets may be used to attach the headrails to the window frame. These brackets may have holes in them through which screws may be driven such that the brackets are secured to the window frame. These brackets may also be adapted to fit around the headrail such that the headrail is selectively secured to the window frame.

Some windows, for example double-hung windows, may be drawn inwardly into the home for cleaning purposes. For instance, U.S. Pat. No. 6,658,794, entitled "Guide Assembly for a Tilt-Out Sash Window", teaches such a window. Furthermore, some windows comprise window screens which may be removed to promote more efficient cleaning of the windows among other things. Some of these window screens may be removed by disengaging the window screen from the window and drawing the window screen inwardly into the home. Among the drawbacks of conventional brackets is that a user may be required to remove the brackets to draw the window and/or window screen inwardly into the home. Such removal may require removal of screws from the window frame which, overtime, may cause wear of the screw holes.

It may be desirable to provide a bracket and/or headrail for window blinds in which the bracket and/or headrail allow for removal of the window and/or window screen without necessitating removal of the bracket. It may also be desirable to provide a bracket and/or headrail for window blinds in which the bracket and/or headrail allow for removal of the window and/or window screen without necessitating removal of any screws.

BRIEF DESCRIPTION OF THE DRAWINGS

While the specification concludes with claims which particularly point out and distinctly claim this technology, it is believed this technology will be better understood from the following description of certain examples taken in conjunction with the accompanying drawings, in which like reference numerals identify the same elements and in which:

Figure 1:
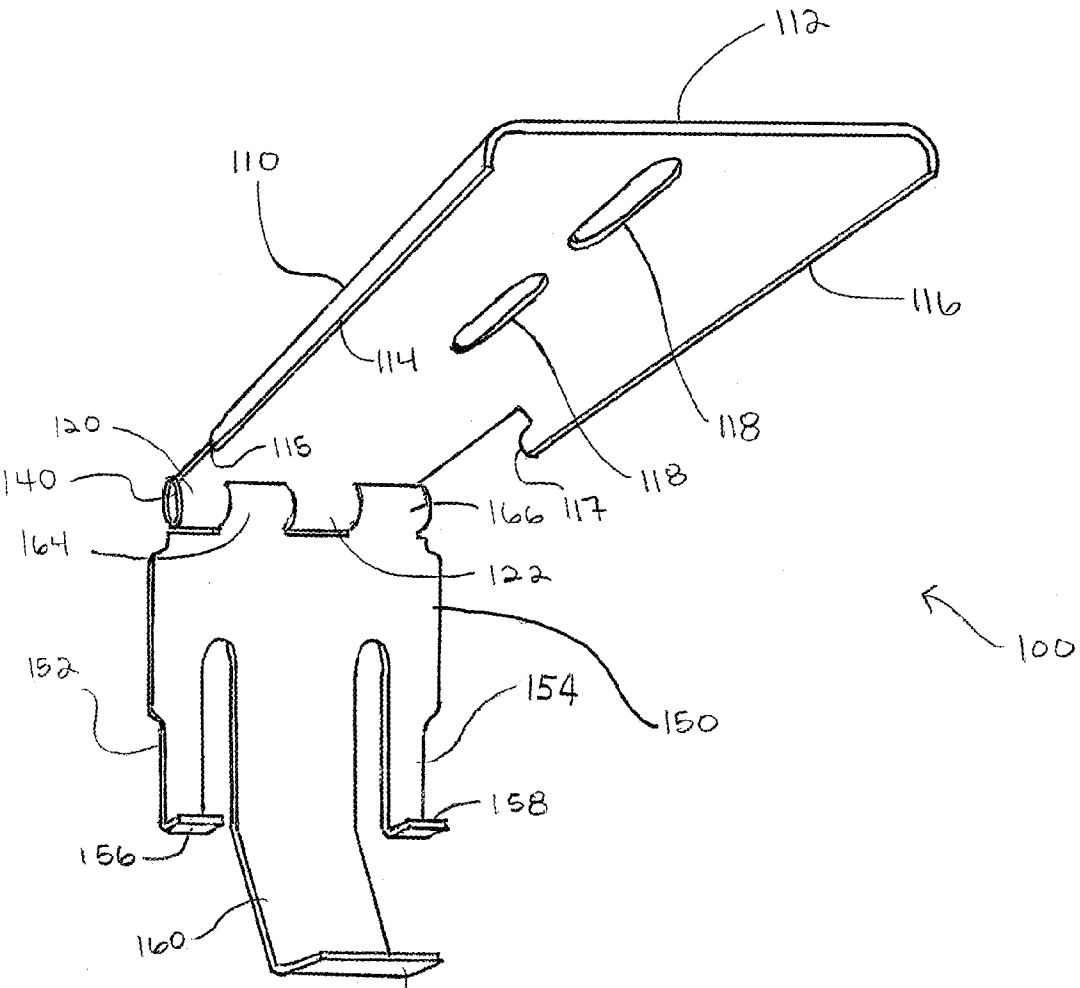
FIG. 1 depicts a perspective view of a bracket constructed in accordance with the teachings of the present disclosure.

The drawings are not intended to be limiting in any way, and it is contemplated that various embodiments of the technology may be carried out in a variety of other ways, including those not necessarily depicted in the drawings. The accompanying drawings incorporated in and forming a part of the specification illustrate several aspects of the present technology, and together with the description serve to explain the principles of the technology; it being understood, however, that this technology is not limited to the precise arrangements shown.

DETAILED DESCRIPTION

The following description of certain examples of the technology should not be used to limit its scope. Other examples, features, aspects, embodiments, and advantages of the technology will become apparent to those skilled in the art from the following description, which is by way of illustration, one of the best modes contemplated for carrying out the technology. As will be realized, the technology described herein is capable of other different and obvious aspects, all without departing from the technology. Accordingly, the drawings and descriptions should be regarded as illustrative in nature and not restrictive.

I. First Bracket

FIGS. 1-6 show a bracket (100) operable for use in a window system as will be described in greater detail below. Bracket (100) is configured to selectively secure a headrail of blinds (20) to an interior surface (12) of the window frame (10). It should be understood that use of the term "blinds" in this specification refers to any type or method of window treatment, including but not limited to, blinds (horizontal, vertical, etc.), curtains, shades, valances, etc. It should also be understood that use of the term "headrail" in the specification refers to any structure which supports the window treatment of any configuration, including but not limited to, a headbox, a rod, etc. The bracket (100) comprises a first member (110) and a second member (150). As will be discussed in more detail below, the first member (110) and the second member (150) are pivotably coupled together.

Figure 2:
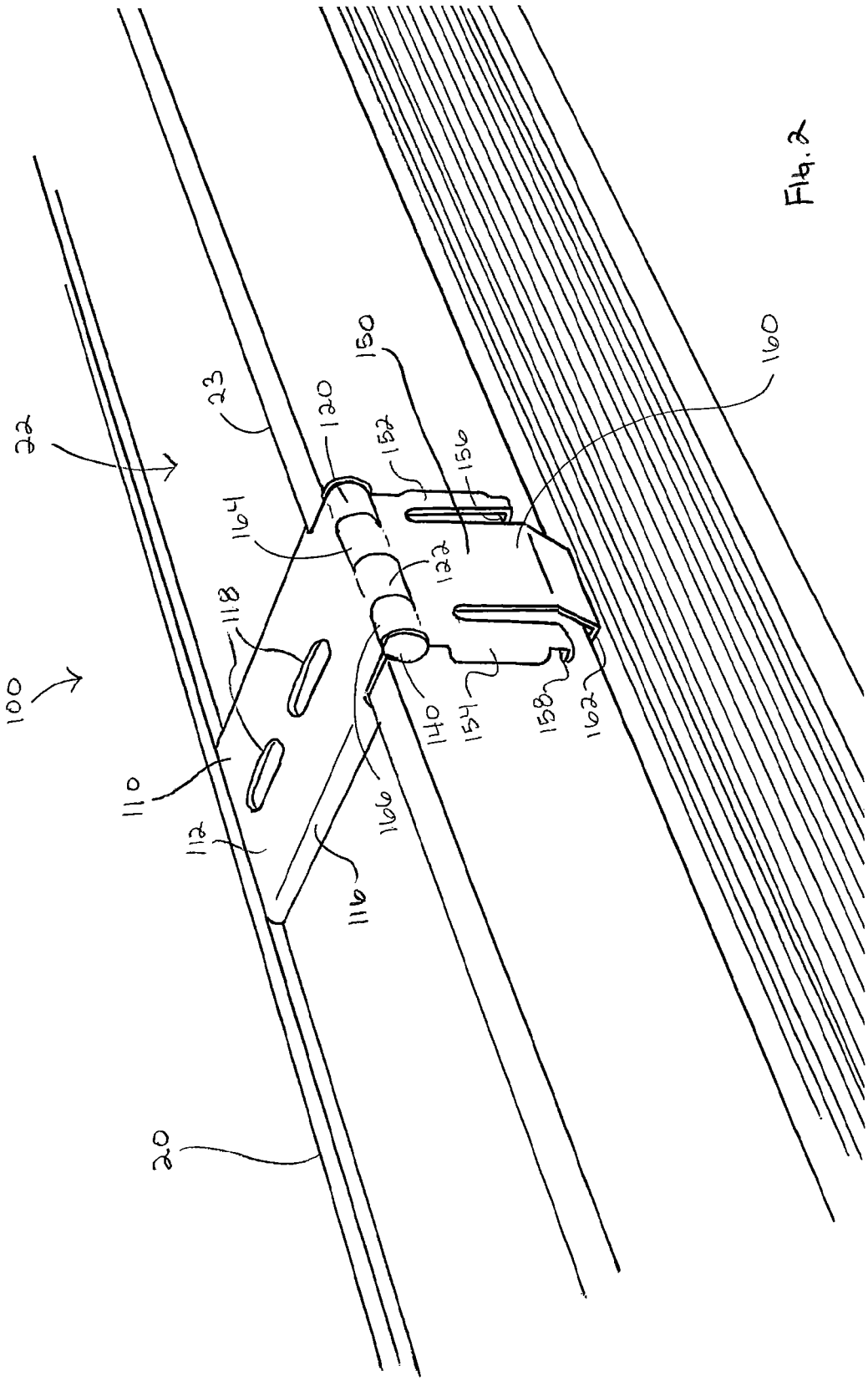
FIG. 2 depicts a perspective view of the bracket of FIG. 1 secured to an exemplary headrail.

The first member (110) presents a U-shaped profile having a generally flat portion (112) and a pair of curved flange members (114, 116) which project from opposite sides of the flat portion (112) along a portion of the flat portion (112). The pair of curved flange members (114, 116) are configured to fit within a channel (22) formed in an upper surface of the headrail of blinds (20) when the bracket (100) is secured to the headrail of blinds (20) as shown in FIG. 2. A pair of tabs (115, 117) extends from an end of the pair of curved flanges (114, 116). The pair of tabs (115, 117) are configured to cooperate with a lip (23) within the channel (22) of the headrail of blinds (20) such that the first member (110) may be secured at least partially within the channel (22). The first member (110) comprises a plurality of openings (118) which pass through the flat portion (112). The plurality of openings (118) are operable to receive a plurality of fasteners (14) to thereby secure the bracket (100) to the interior surface (12) of the window frame (10) such that a top surface of the flat portion (110) is disposed adjacent to the interior surface (12) of the window frame (10). The plurality of openings (118) of the present example comprises two elongated openings oriented along a common axis. It should be understood that, although the plurality of openings (118) of the present example comprises two elongated openings oriented along a common axis, any number of openings oriented in any suitable manner may be used and would be apparent to one of ordinary skill in the art according to the teachings herein. For instance, the plurality of openings (118) may comprise a single elongated opening extending along the flat portion (112). Alternatively, the plurality of openings (118) may comprise four circular openings arranged in a rectangular orientation along the flat portion (112).

The second member (150) includes a pair of spaced apart resilient arms (152, 154) and a resilient locking member (160). The resilient arms (152, 154) each comprise an inwardly extending tab (156, 158). The locking member (160) likewise comprises an inwardly extending tab (162). The tab (162) of the locking member (160) is configured to selectively engage a bottom edge of a side surface of the headrail of blinds (20) such that the second member (150) is secured to the headrail of blinds (20) as shown in FIG. 2. The tabs (156, 158) of the arms (152, 154) are configured to bear against the same side surface of the headrail of blinds (20). It should therefore be understood that the bracket (100) will be secured to the headrail of blinds (20) by the tabs (115, 117) of the first member (110) and the tabs (156, 158) of the second member (150).

The first member (110) is pivotably coupled with the second member (150). The first member (110) and the second member (150) each comprise a pair of cylindrical knuckles (120, 122, 164, 166). Each cylindrical knuckle of pair of the cylindrical knuckles (120, 122, 164, 166) comprises a circular opening that passes through the respective knuckle. The pair of cylindrical knuckles (120, 122) of the first member (110) and the pair of cylindrical knuckles (164, 166) of the second member (150) are offset relative to one another such that the pair of cylindrical knuckles (120, 122) interlock with the pair of cylindrical knuckles (164, 166) such that the pair of cylindrical knuckles (120, 122, 164, 166) forms one continuous cylinder as shown in FIG. 1. A pin (140) is disposed through each opening of the pair of cylindrical knuckles (120, 122, 164, 166) when arranged as a continuous cylinder such that the first member (110) and the second member (150) are operable to rotate about the pin (140). It should therefore be understood that, the first member (110) and the second member (150) are pivotably coupled together by a hinge. As will be discussed in more detail below, the bracket (100) is operable to move from an open position to a closed position or vice versa. In operation, the bracket (100) is configured to receive the headrail of blinds (20) in the open position. Non-metallic, or any suitable material, washers or separators may be positioned between the knuckles (120, 122, 164, 166) and may preclude direct contact between the knuckles (120, 122, 164, 166). Although the first member (110) and the second member (150) of the present example are pivotably coupled together by a hinge, it should be understood that first member the (110) and the second member (150) may be pivotably coupled by any appropriate method. For instance, the first member (110) and the second member (150) may be pivotably coupled together by a living hinge.

Figure 3A:
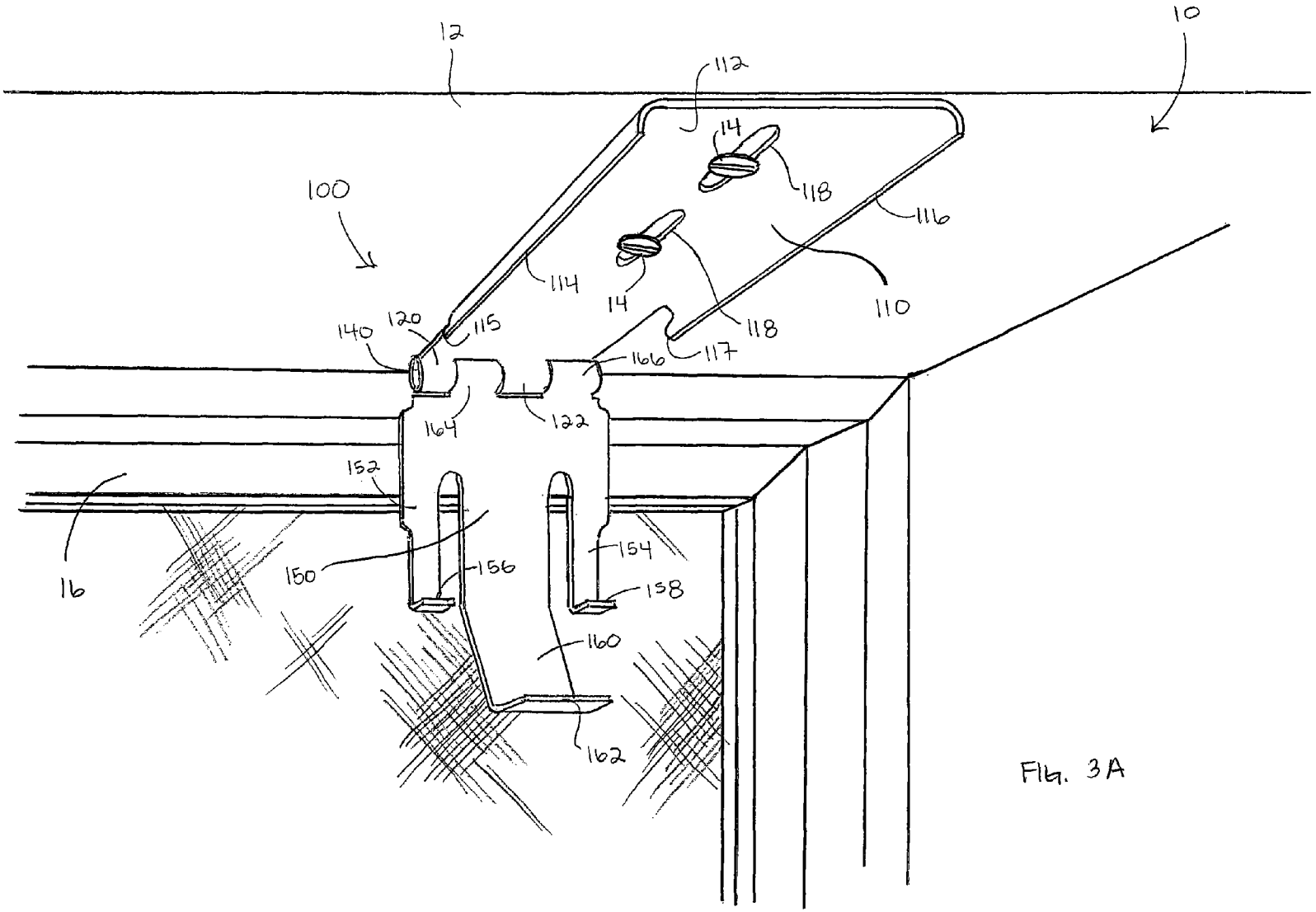
FIG. 3A depicts a perspective view of the bracket of FIG. 1 in an open position and attached to a window frame adjacent to a window screen.
Figure 3B:
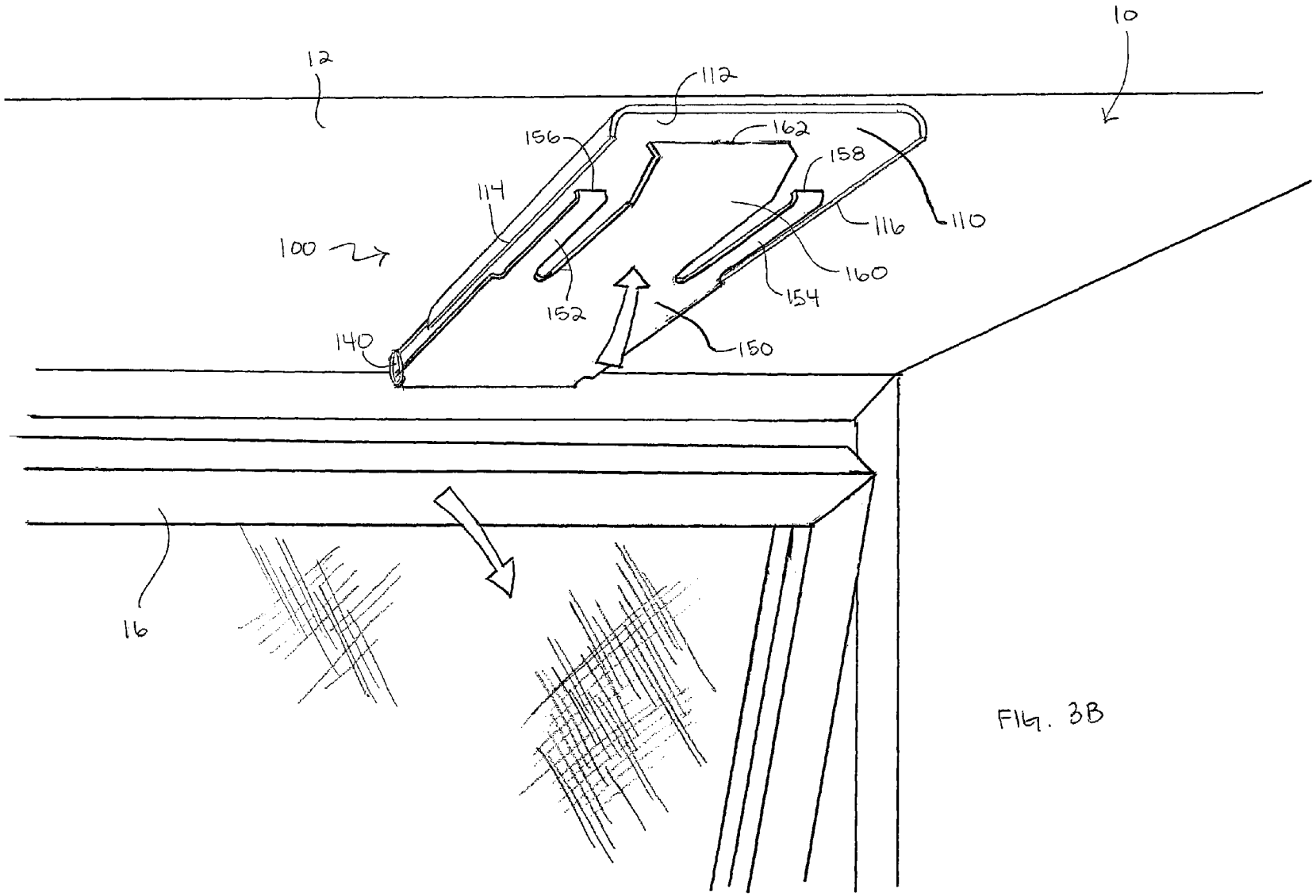
FIG. 3B depicts a perspective view of the bracket of FIG. 1 in a closed position and attached to the window frame, with the window screen removed.
Figure 4B:
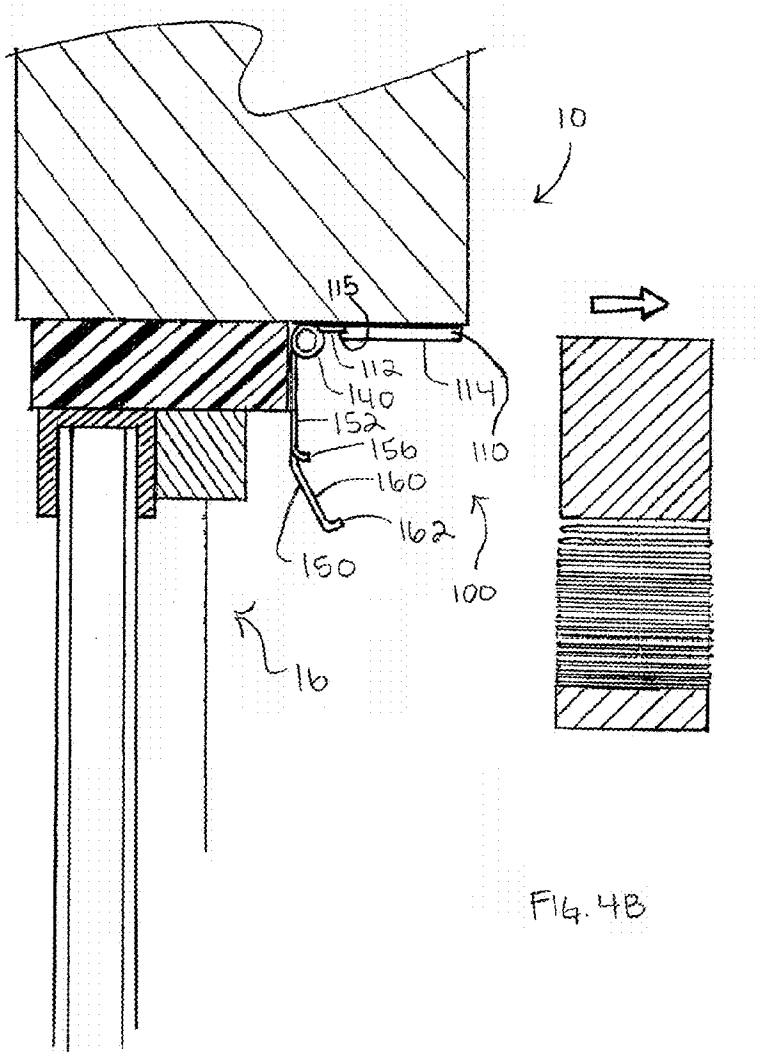
FIG. 4B depicts a cross-sectional view of the bracket of FIG. 1 in the open position with the headrail of blinds removed, and with the bracket attached to the window frame adjacent to the window screen.
Figure 4A:
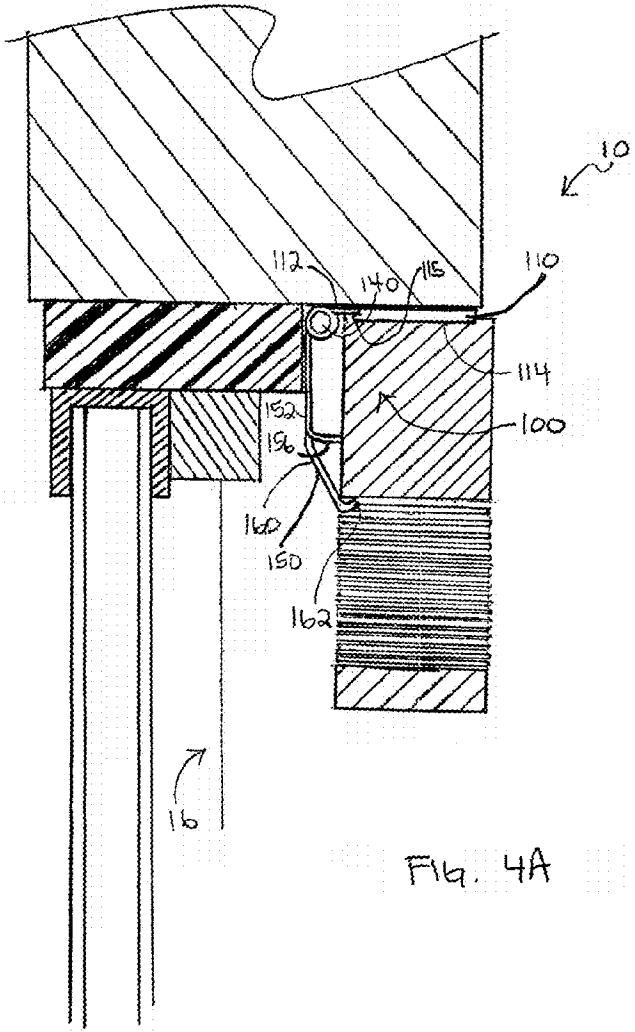
FIG. 4A depicts a cross-sectional view of the bracket of FIG. 1 in the open position with the headrail of blinds secured therein, and with the bracket attached to the window frame adjacent to the window screen.
Figure 4D:
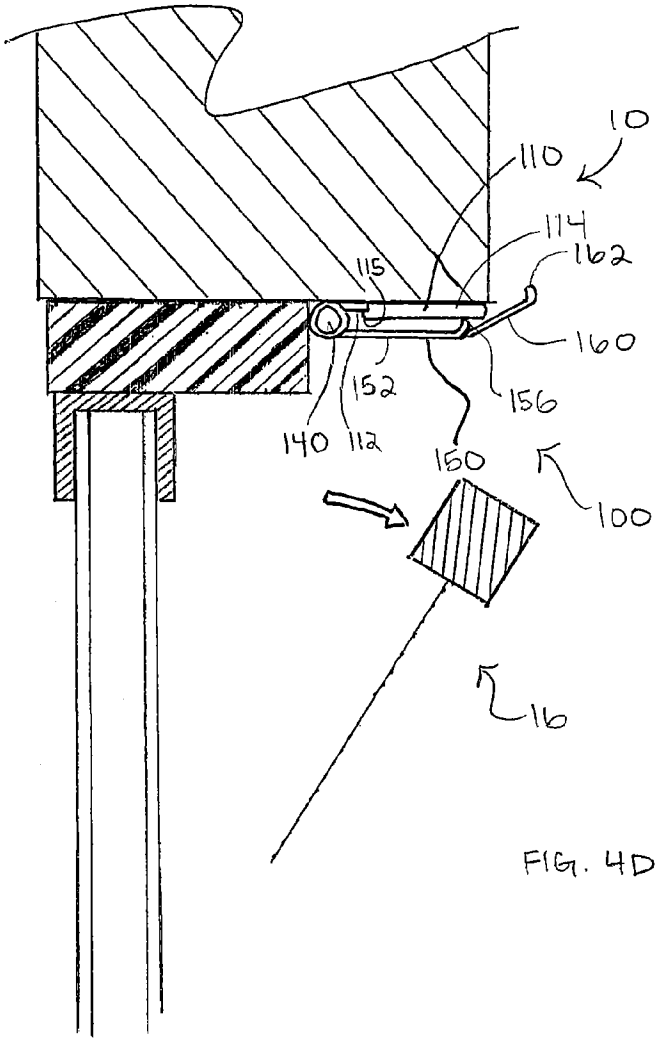
FIG. 4D depicts a cross-sectional view of the bracket of FIG. 1 in the closed position and attached to the window frame, with the window screen removed.
Figure 4C:
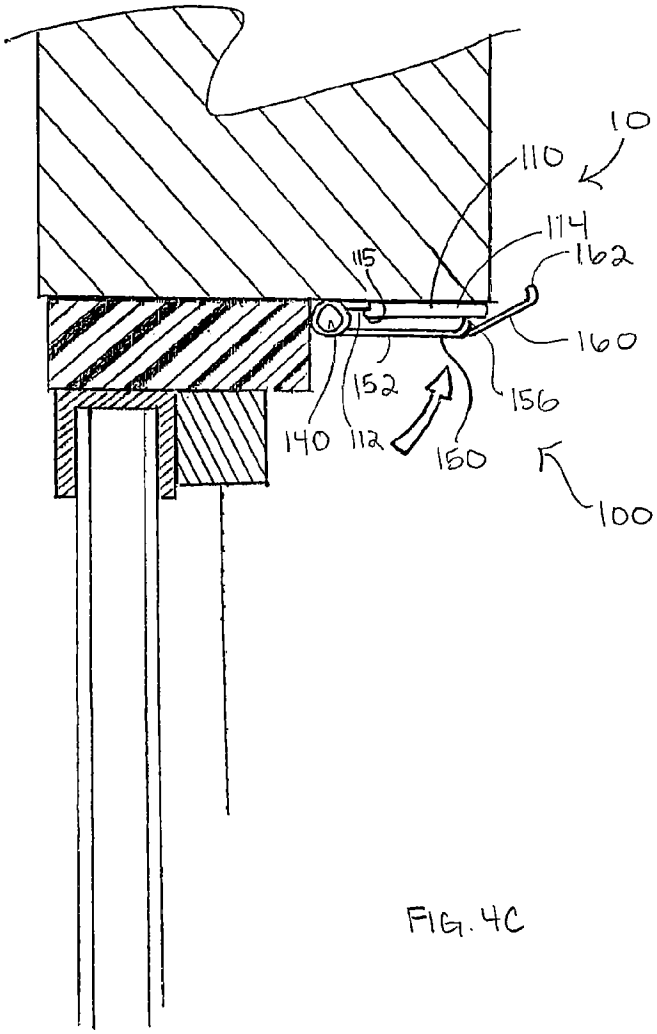
FIG. 4C depicts a cross-sectional view of the bracket of FIG. 1 moved into the open position and attached to the window frame adjacent to the window screen.

FIG. 4A shows the headrail of blinds (20) secured within the bracket (100) which is secured to the interior surface (12) of the window frame (10) via the fasteners (14) passing through the plurality of openings (118). The bracket (100) is operable to receive and selectively secure the headrail of blinds (20) within the bracket (100) while in the open position. FIGS. 3A and 4B show the bracket (100) with the headrail of blinds (20) removed from the bracket (100). As can be seen in FIGS. 3A and 4B, in the open position, it is impossible to remove a window screen (16) without first moving the second member (150) out of the way. It should therefore be understood that, if the bracket (100) was not capable of moving to the closed position, it would be necessary to remove the bracket (100) entirely in order to remove the window screen (16) in the manner shown. As shown in FIGS. 3B and 4C, however, the bracket (100) of the present example is operable to move into the closed position such that the second member (150) no longer inhibits removal of the window screen (16). In this closed position, the window screen (16) may be removed without removing the bracket (100) from the window frame (10) as shown in FIGS. 3B and 4D.

In some versions of the bracket (100) it may be advantageous to bias the bracket (100) toward the open position or toward the closed position. For instance, as shown in FIG. 5, a torsion spring (18) may be positioned between the first member (110) and the second member (150). The torsion spring (18) may be configured to urge the first member (110) and the second member (150) toward the open position or toward the closed position. It should be understood that, although the bracket (100) of the present example comprises the torsion spring (18) to bias the bracket (100) toward the open position or toward the closed position, any other biasing member may be used and would be apparent to one of ordinary skill in the art according to the teachings herein. For instance, a leaf spring may be positioned between the first member (110) and the second member (150). Furthermore, it should be understood that the biasing member may be placed in any operable position relative to the first member (110) and the second member (150) and that any number of biasing members may be used to bias the bracket (100). Finally, it should be appreciated that in versions of the bracket (100) wherein the first member (110) and the second member (150) are pivotably coupled together by a living hinge, the living hinge may be resiliently biased to urge the first member (110) and the second member (150) toward the open position or toward the closed position.

Figure 5B:
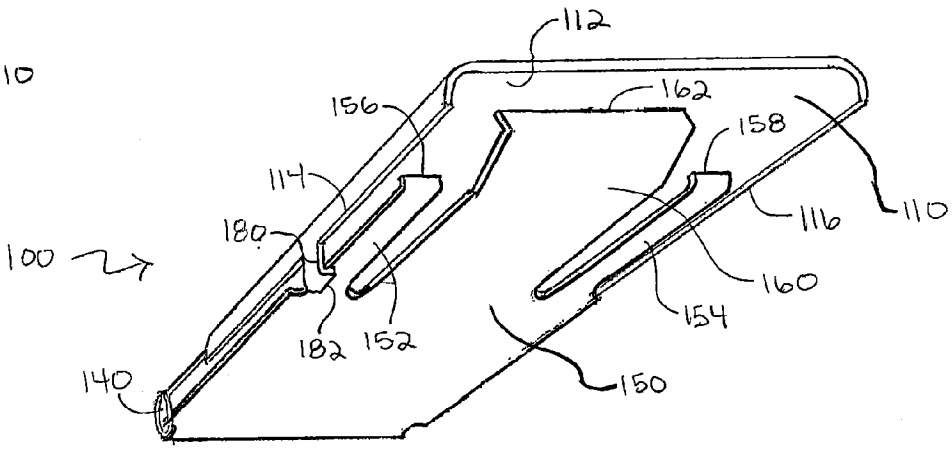
FIG. 5B depicts a perspective view of the bracket of FIG. 5A in the closed position.
Figure 5A:
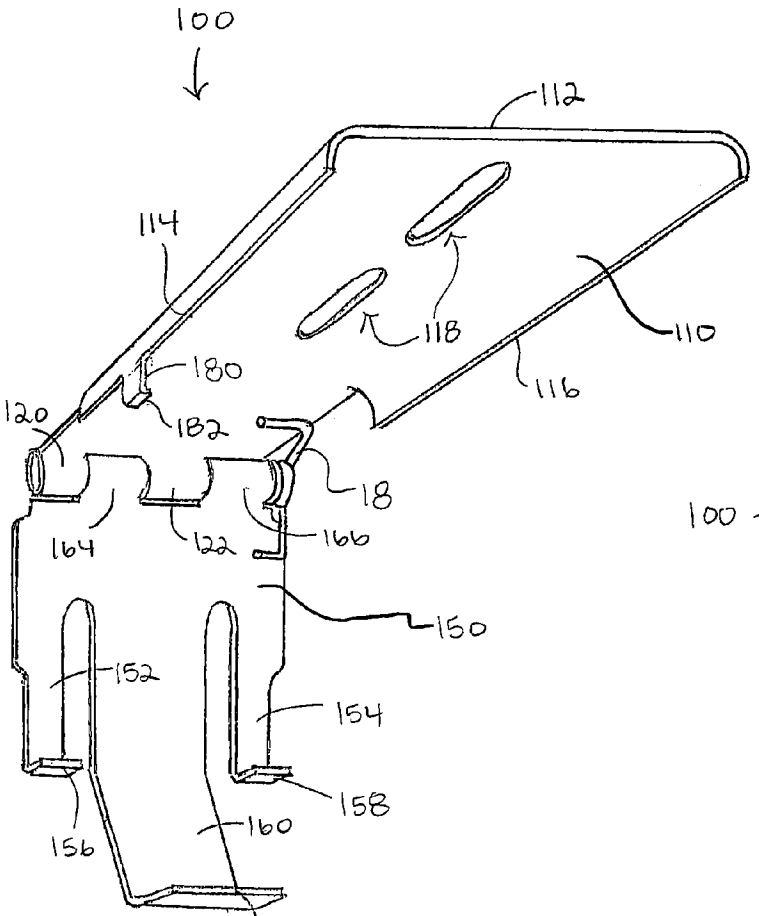
FIG. 5A depicts a perspective view of an alternative embodiment of the bracket of FIG. 1 in the open position with a locking feature.
Figure 6:
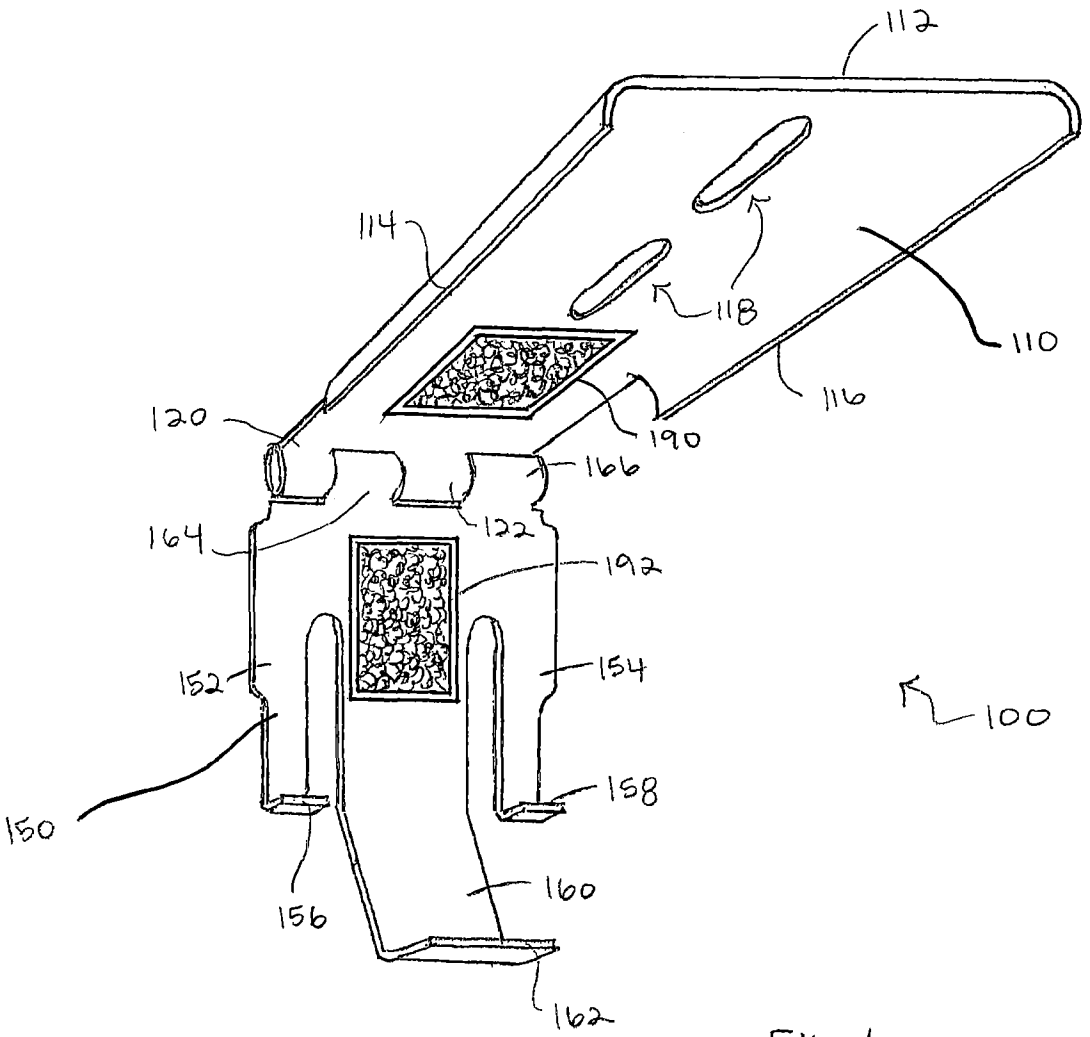
FIG. 6 depicts a perspective view of the bracket of FIG. 1 with an alternative locking feature.

In some versions of the bracket (100) it may be advantageous to provide a feature which "locks" the bracket (100) in the closed position. For instance, FIG. 5A shows a resilient locking arm (180) extending downwardly from the curved flange member (114). A tab (182) projects inwardly from the locking arm (180) such that when the bracket (100) is moved into the closed position, the tab (182) couples about an exterior edge of the resilient arm (152), as shown in FIG. 5B, thus "locking" the bracket (100) in the closed position. It should be understood that, the locking arm (180) may be placed in any operable position and further that any number of the locking arms (180) may be used to "lock" the bracket (100). It should also be understood that, although the bracket (100) of the present example comprises the locking arm (180) to "lock" the bracket (100) in the closed position, any other locking feature may be used and would be apparent to one of ordinary skill in the art according to the teachings herein. For instance, FIG. 6 shows a set of hook and loop pads (190, 192) positioned on a bottom surface of the flat portion (112) of the first member (110) and an interior surface of the second member (150). The pads (190, 192) are oriented such that the pads (190, 192) align when the bracket (100) is in the closed position thereby "locking" the bracket (100) in the closed position.

It should be appreciated that any appropriate number of the brackets (100) may be used to secure the headrail of blinds (20) to the window frame (10). It should further be appreciated that although the bracket (100) is discussed in the context of use with the headrail of blinds (20) and the window frame (10), the bracket (100) may be used for any purpose and would be apparent to one of ordinary skill in the art according to the teachings herein.

II. Second Bracket

Figures 7, 8:
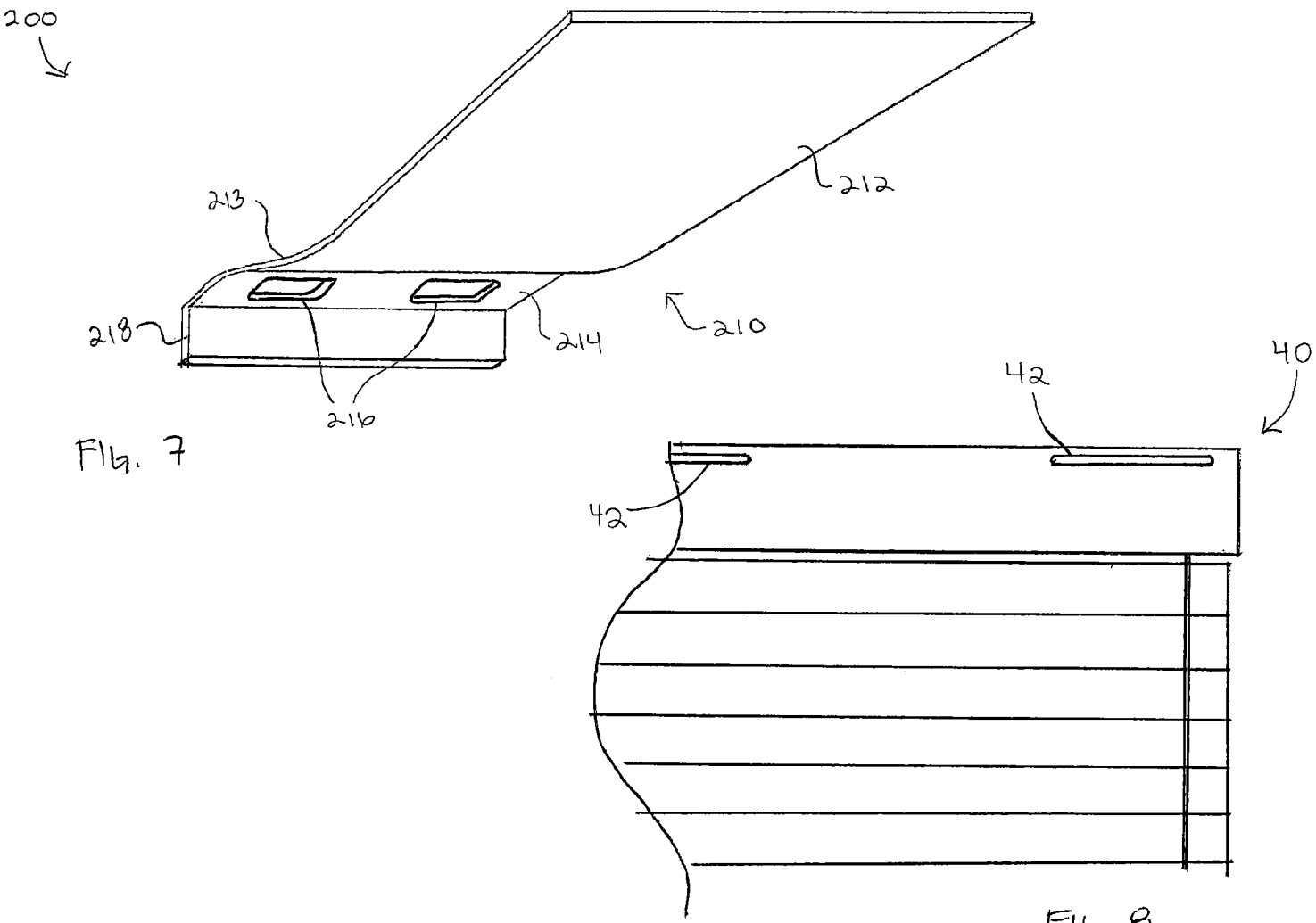
FIG. 7 depicts a perspective view of an alternative bracket constructed in accordance with the techniques of the present disclosure.
FIG. 8 depicts an elevational view of an alternative headrail of blinds.

FIG. 7 shows an alternative bracket (200) operable for use in a window system as will be described in greater detail below. Bracket (200) is configured to selectively secure an alternative headrail of blinds (40) to the interior surface (12) of the window frame (10). The bracket (200) comprises a curved member (210) having a first flat portion (212), a second flat portion (214), and a curved portion (213). The curved portion (213) is positioned between the first flat portion (212) and the second flat portion (214). The second flat portion (214) comprises a plurality of openings (216). The plurality of openings (216) are operable to receive a plurality of fasteners (54) to thereby secure the bracket (200) to the interior surface (12) of the window frame (10) such that a top surface of the second flat portion (214) is disposed adjacent to the interior surface (12) of the window frame (10). The plurality of openings (216) of the present example comprises two elongated openings oriented along a common axis. It should be understood that, although the plurality of openings (216) of the present example comprises two elongated openings oriented along a common axis, any number of openings oriented in any manner may be used and would be apparent to one of ordinary skill in the art according to the teachings herein. For instance, the plurality of openings (216) may comprise a single elongated opening extending along the second flat portion (214). Alternatively, the plurality of openings (216) may comprise a pair of circular openings arranged along a common axis.

Figure 9A:
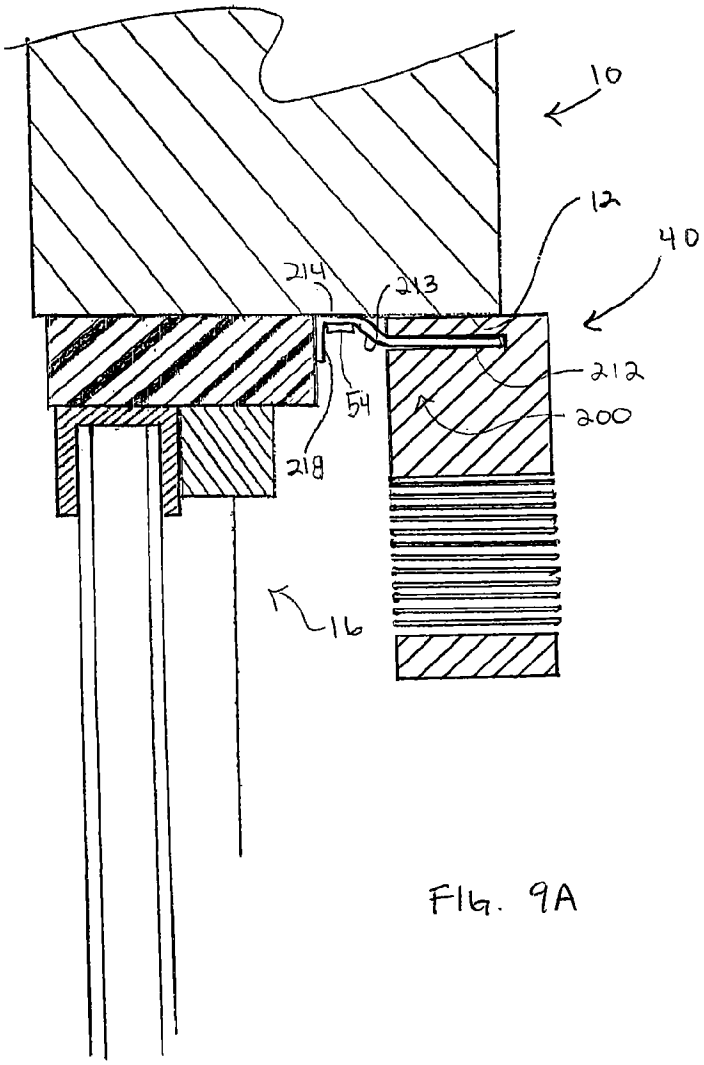
FIG. 9A depicts a cross-sectional view of the bracket of FIG. 7 attached to a window frame adjacent to a window screen, with the headrail of blinds of FIG. 8 secured to the bracket.
Figure 9C:
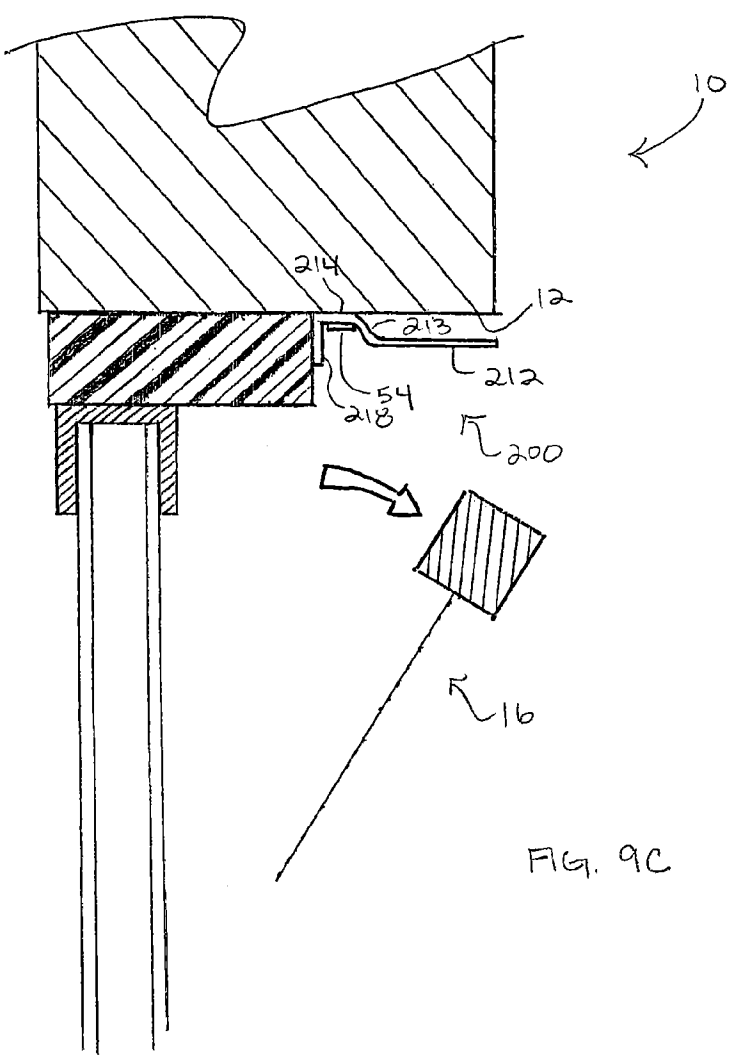
FIG. 9C depicts a cross-sectional view of the bracket of FIG. 7 attached to the window frame, with the window screen removed.
Figure 9B:
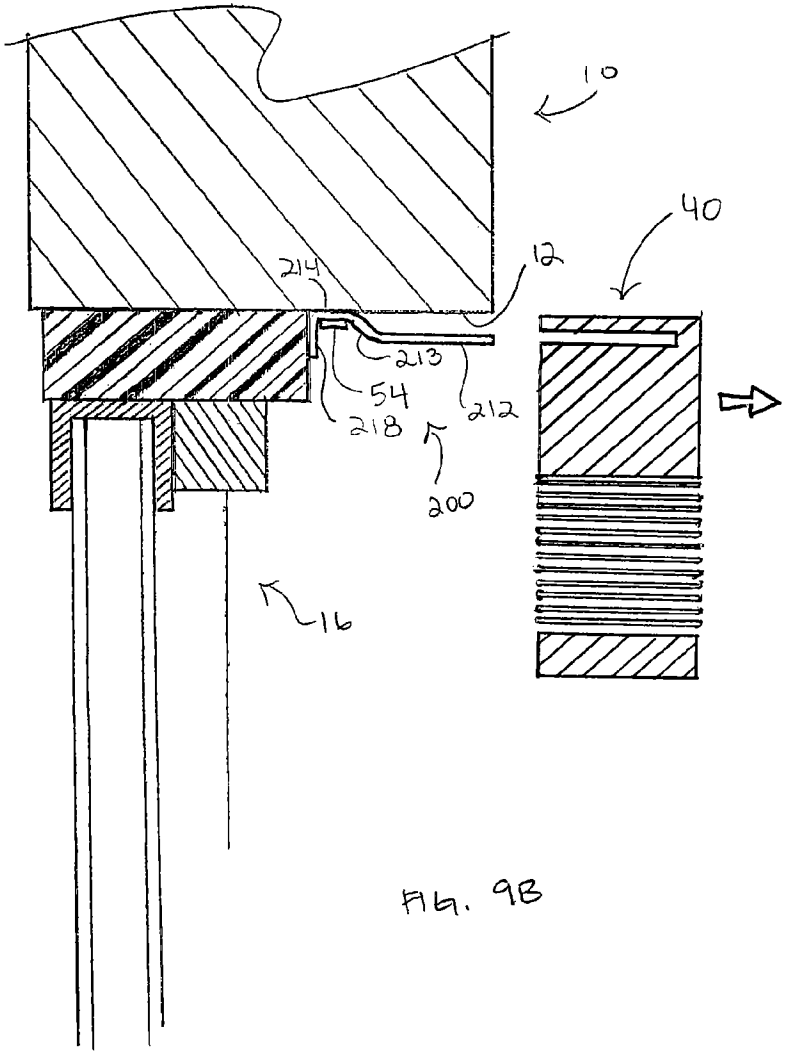
FIG. 9B depicts a cross-sectional view of the bracket of FIG. 7 attached to the window frame adjacent to the window screen, with the headrail of blinds of FIG. 8 removed.

As best seen in FIGS. 9A-9B, with the second flat portion (214) pressed flush against the interior surface (12) of the window frame (10), the curved portion (213) is configured such that the first flat portion (212) extends generally parallel to the interior surface (12) of the window frame (10) thus defining a gap between the first flat portion (212) and the interior surface (12). Alternatively, the first flat portion (212) may extend at a slight upward angle from the curved portion (213) so as to urge the headrail of blinds (40) upward against an interior surface of the window frame (10), thus pinching the headrail of blinds (40) between the first flat portion (212) and the interior surface of the window frame (10) as will be understood from the discussion below. As shown in FIG. 8, the headrail of blinds (40) comprises a plurality of slots (42) extending at least partially through the headrail of blinds (40) from an exterior surface of headrail of blinds (40). The plurality of slots (42) is positioned a distance from a top surface of headrail of blinds (40) substantially similar to the gap between the first flat portion (212) and the interior surface (12). Each slot (42) of the plurality of slots (42) is configured to slidably receive the first flat portion (212) of each bracket (200). With the bracket (200) slidably disposed within the slot (42), the headrail of blinds (40) is secured to the window frame (10). A flat member (218) projects from the second flat portion (214) of the curved member (210) and is configured to bear against a portion of the window frame (10) to, among other things, add to the rigidity and strength of the bracket (200).

The flat member (218) is sized such that the flat member (218) does not inhibit removal of the window screen (16).

As shown in FIG. 9A, to remove the window screen (16), the headrail of blinds (40) must first be removed from the bracket (200). Once the headrail of blinds (40) is removed, from the bracket (200), the window screen (16) may be removed without requiring removal of the bracket (200) as shown in FIG. 9B.

The first flat portion (212) of the bracket (200) may comprise a locking feature configured to selectively secure the bracket (200) within the slot (42). The slot (42) may comprise a mating locking feature to engage the locking feature of the bracket (200). It should be understood that, the plurality of slots (42) may extend partially or completely through the headrail of blinds (40) such that the first flat portion (212) of the bracket (200) may extend partially or completely through the headrail of blinds (40). It should also be understood that, the first flat portion (212) may be angled upward to thereby drive the headrail of blinds (40) upward into the interior surface (12) of the window frame (10), thus pinching headrail between first the flat portion (212) and the interior surface (12).

It should be appreciated that any appropriate number of the brackets (200) may be used to secure the headrail of blinds (40) to the window frame (10). It should further be appreciated that although the bracket (200) is discussed in the context of use with the headrail of blinds (40) and the window frame (10), the bracket (200) may be used for any purpose and would be apparent to one of ordinary skill in the art according to the teachings herein.

III. Third Bracket

Figure 10:
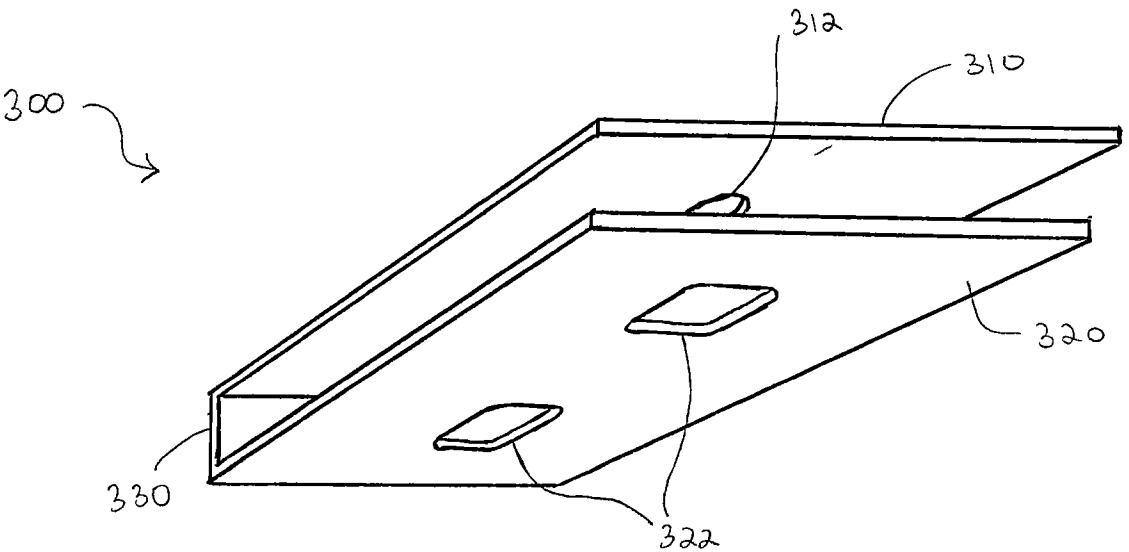
FIG. 10 depicts a perspective view of another alternative bracket constructed in accordance with the techniques of the present disclosure.
Figure 11:
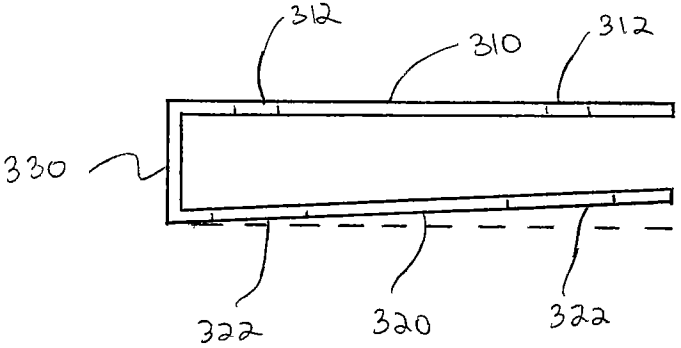
FIG. 11 depicts a side elevational view of the bracket of FIG. 10.

FIG. 10 shows another alternative bracket (300) operable for use in a window system as will be described in greater detail below. Bracket (300) is configured to selectively secure the headrail of blinds (40) to the interior surface (12) of the window frame (10). The bracket (300) comprises a first flat member (310) and a second flat member (320) each extending from a third flat member (330) and thus defining a gap there between. As best seen in FIG. 11, the first flat member (310) extends perpendicularly from the third flat member (330) whereas the second flat member (320) extends at a slight upward angle from the third flat member (330). As will be discussed in more detail below, this upward angle of the second flat member (320) will drive the headrail of blinds (40) upward into the first flat member (310), thus pinching the headrail of blinds (40) between the first flat member (310) and the second flat member (320).

The first flat member (310) comprises a plurality of openings (312). The plurality of openings (312) are operable to receive a plurality of fasteners (64) to thereby secure the bracket (300) to the interior surface (12) of the window frame (10) such that a top surface of the first flat member (310) is pressed flush against the interior surface (12) of the window frame (10). The plurality of openings (312) of the present example comprises two circular openings oriented along a common axis. It should be understood that, although the plurality of openings (312) of the present example comprises two circular openings oriented along a common axis, any number of openings oriented in any manner may be used and would be apparent to one of ordinary skill in the art according to the teachings herein.

The second flat member (320) also comprises a plurality of openings (322) aligned with the plurality of openings (312) of the first flat member (310). The plurality of openings (322) are operable to allow the plurality of fasteners (64) to pass completely through to thereby engage the first flat member (310). The plurality of openings (322) of the present example comprises two rounded-square openings oriented along a common axis. It should be understood that, although the plurality of openings (322) of the present example comprises two rounded-square openings oriented along a common axis, any number of openings oriented in any manner may be used and would be apparent to one of ordinary skill in the art according to the teachings herein.

As discussed above, the headrail of blinds (40) comprises the plurality of slots (42) extending inwardly from an exterior surface of the headrail of blinds (40). The plurality of slots (42) is positioned a distance from a top surface of the headrail of blinds (40) substantially similar to the gap between the first flat member (310) and the second flat member (320). Each slot (42) of the plurality of slots (42) is configured to slidably receive the second flat member (320) of each bracket (300). With the bracket (300) slidably disposed within the slot (42), the headrail of blinds (40) is pinched between the first flat member (310) and the second member (320) and is thereby selectively secured to the window frame (10). The third flat member (330) is configured to be disposed against a portion of the window frame (10) to, among other things, add to the rigidity and strength of the bracket (300). The third flat member (330) is sized such that neither the third flat member (330) nor the second flat member (320) inhibits removal of the window screen (16).

Figure 12A:
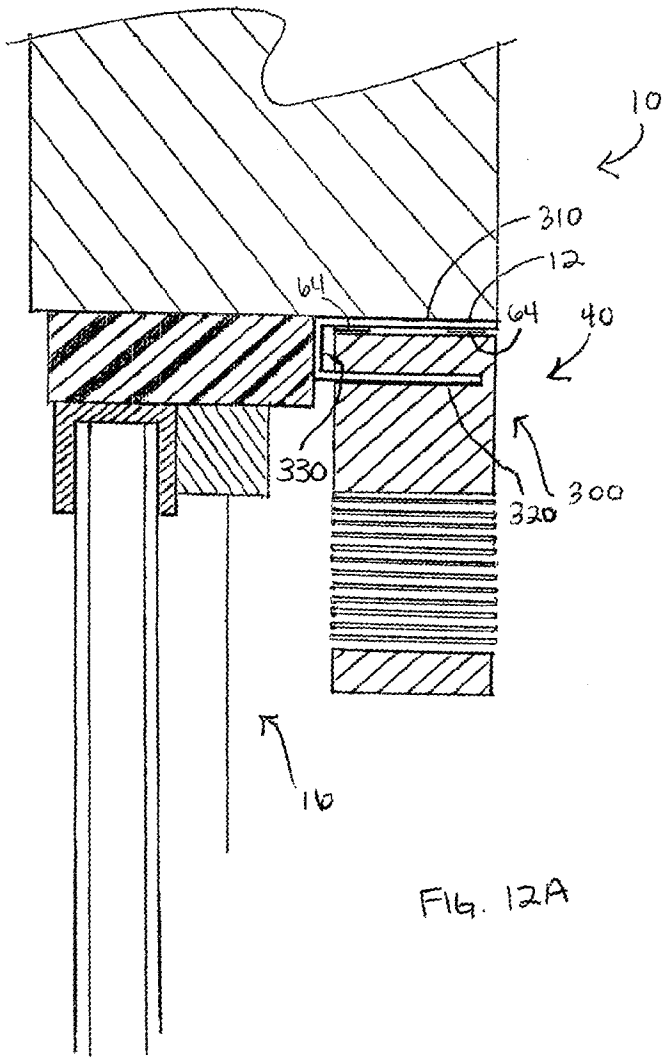
FIG. 12A depicts a cross-sectional view of the bracket of FIG. 10 attached to a window frame adjacent to a window screen, with the headrail of blinds of FIG. 8 secured to the bracket.
Figure 12C:
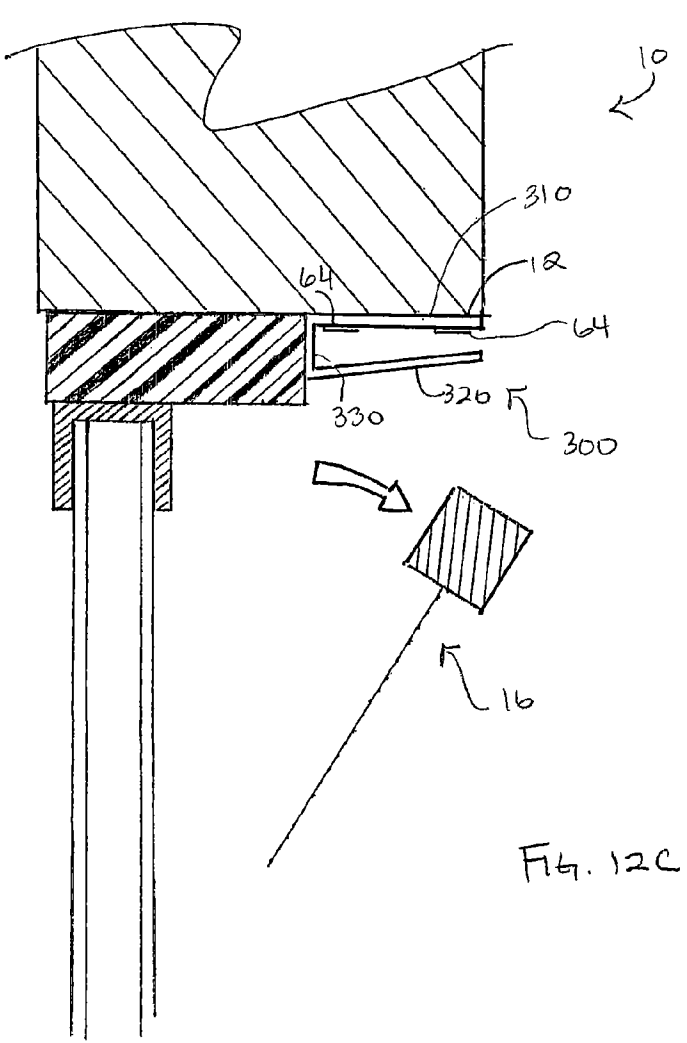
FIG. 12C depicts a cross-sectional view of the bracket of FIG. 10 attached to the window frame, with the window screen removed.
Figure 12B:
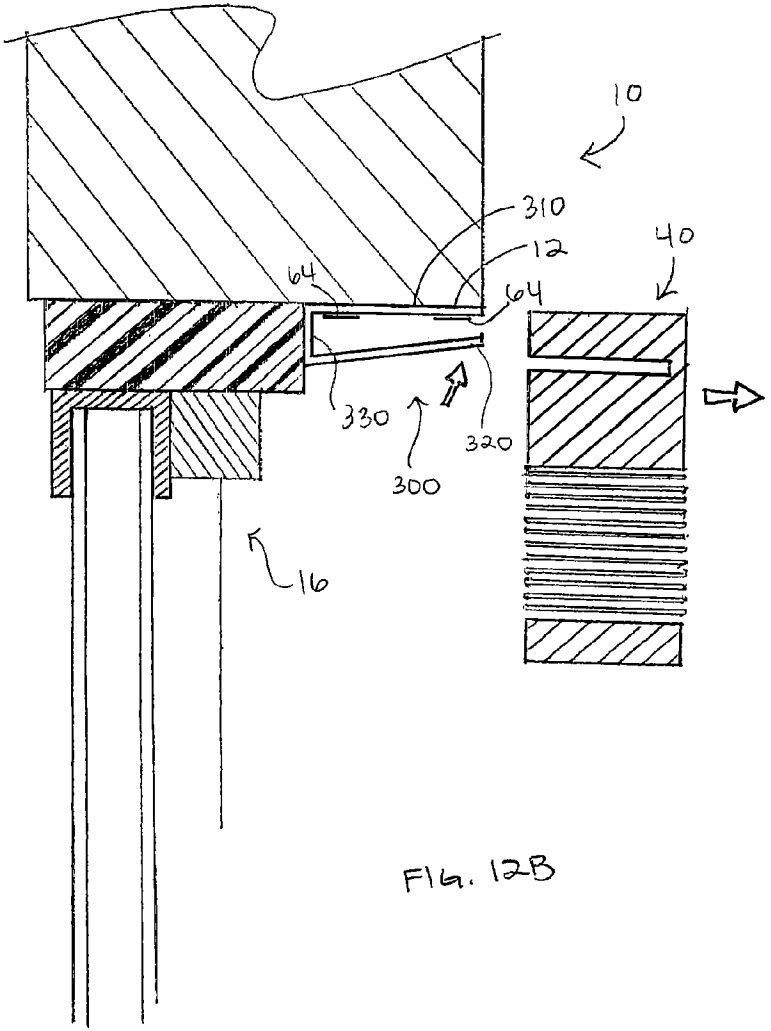
FIG. 12B depicts a cross-sectional view of the bracket of FIG. 10 attached to the window frame adjacent to the window screen, with the headrail of blinds of FIG. 8 removed.

As shown in FIG. 12A, to remove the window screen (16), the headrail of blinds (40) must first be removed from the bracket (300). Once the headrail of blinds (40) is removed, from the bracket (300), the window screen (16) may be removed without requiring removal of the bracket (300) as shown in FIG. 12B.

The second flat member (320) of the bracket (300) may comprise a locking feature configured to selectively secure the bracket (300) within the slot (42). The slot (42) may comprise a mating locking feature to engage the locking feature of the bracket (300). It should be understood that, the plurality of slots (42) may extend partially or completely through the headrail of blinds (40) such that the second flat member (320) of the bracket (300) may extend partially or completely through the headrail of blinds (40).

It should be appreciated that any appropriate number of the brackets (300) may be used to secure the headrail of blinds (40) to the window frame (10). It should further be appreciated that although the bracket (300) is discussed in the context of use with a the headrail of blinds (40) and the window frame (10), the bracket (300) may be used for any purpose and would be apparent to one of ordinary skill in the art according to the teachings herein.

IV. First Rotatable Fastener

It may be necessary to allow a user to selectively remove a bracket from a window frame (10) without requiring removal of the fastener(s) securing the bracket to the window frame (10). It may further be necessary to allow such selective removal of a bracket while the bracket is attached to the headrail of blinds (20). (It should be understood that the headrail of blinds (20) have been omitted from FIGS. 18A and 18B for the sake of clarity.) FIGS. 13-18B show a fastener (400) operable for use in a window system as will be described in greater detail below. Fastener (400) is operable to allow a user to selectively remove and/or secure a bracket (450), whether secured to the headrail of blinds (20), to the window frame (10) without requiring removal of a screw (440), which secures the bracket (450) to the window frame (10).

Figure 14:
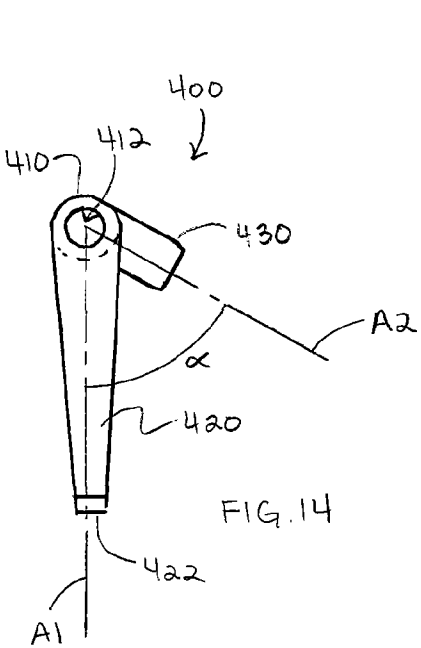
FIG. 14 depicts a top view of the fastener of FIG. 13.
Figure 13:
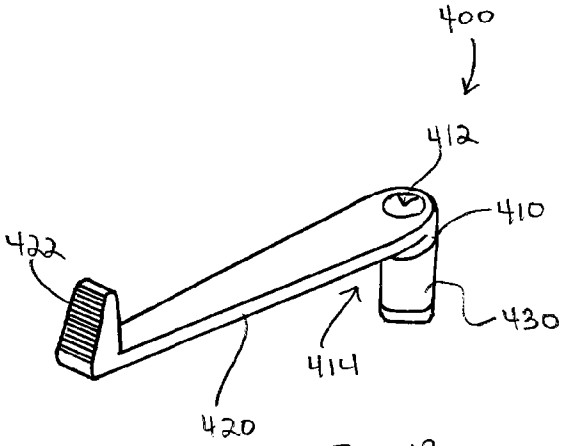
FIG. 13 depicts a perspective view of a fastener constructed in accordance with the techniques of the present disclosure.
Figure 15:
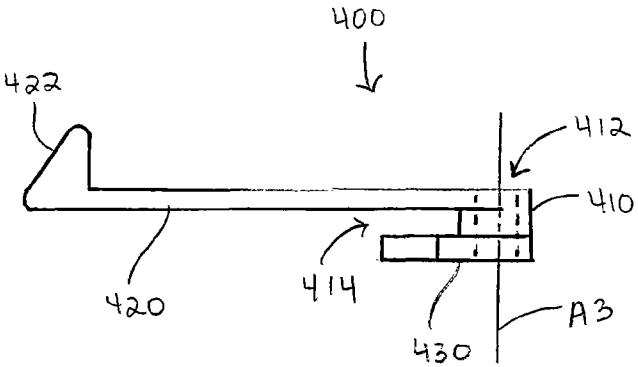
FIG. 15 depicts a side elevational view of the fastener of FIG. 13.

As best seen in FIGS. 13-15, the fastener (400) comprises a cylindrical body (410), a lever arm (420), and a locking member (430). The lever arm (420) and the locking member (430) extend form the cylindrical body (410). As best seen in FIG. 14, the lever arm (420) extends from the cylindrical body (410) along a first axis (A1), and the locking member (430) extends from the cylindrical body (410) along a second axis (A2). The first axis (A1) and the second axis (A2) are oriented such that the first axis (A1) and the second axis (A2) define an angle (α) between them. For instance, the angle (α) may be 45°; it should be understood however, that any appropriate angle may be used. A cylindrical opening (412) passes completely through the cylindrical body (410) along a third axis (A3). As will be discussed in more detail below, the screw (440) passes through the opening (412) to rotatably secure the fastener (400) to the interior surface (12) of the window frame (10). The lever arm (420) includes a paddle (422) positioned at an end of the lever arm (420) opposite of the cylindrical body (410). As will be discussed in more detail below, a user engages the paddle (422) of the lever arm (420) to thereby rotate the fastener (400) about the third axis (A3) from an unlocked position to a locked position.

Figure 16A:
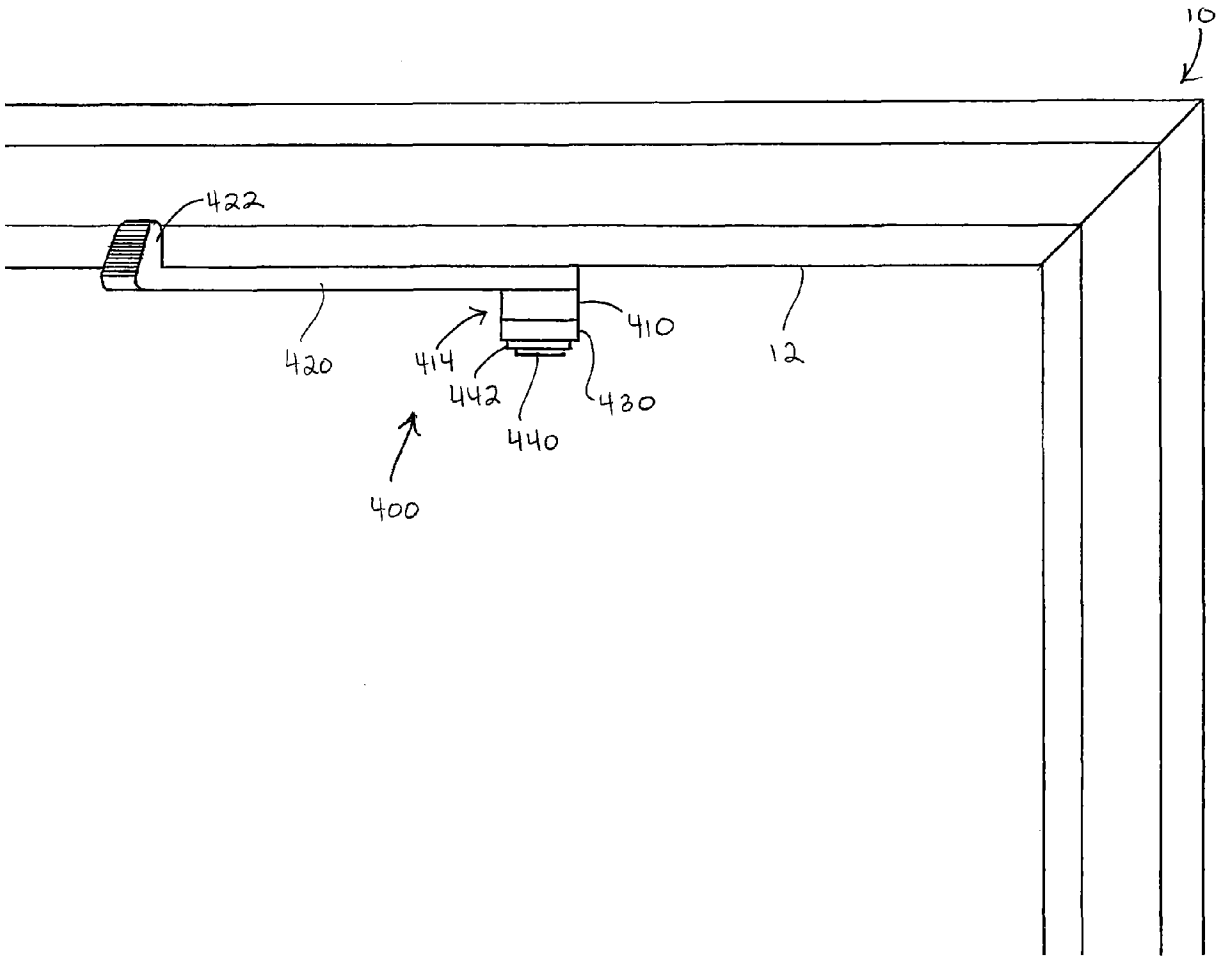
FIG. 16A depicts a side elevational view of the fastener of FIG. 13 rotatably secured to a window frame, with the fastener in a first position.
Figure 16B:
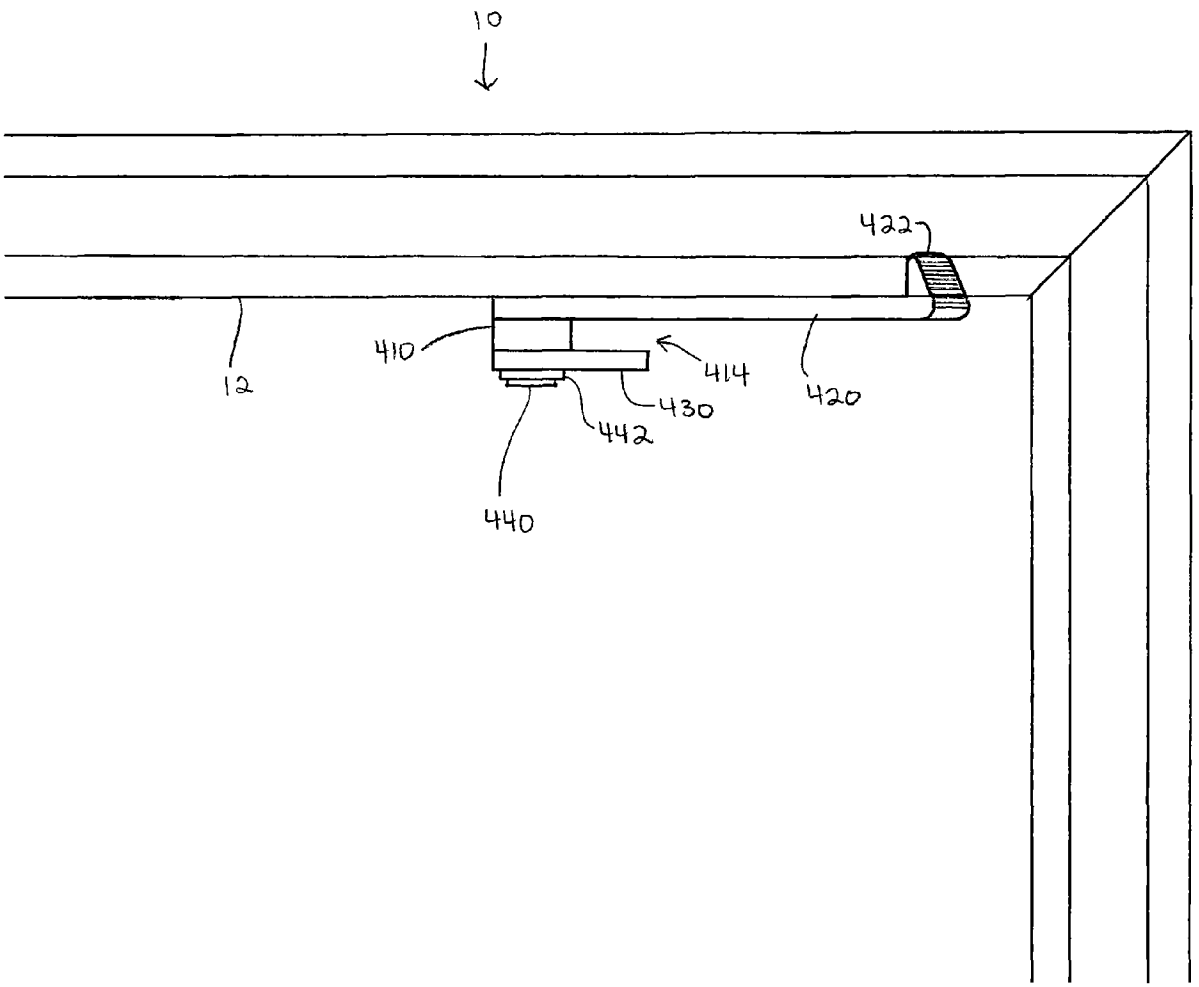
FIG. 16B depicts a side elevational view of the fastener of FIG. 13 rotatably secured to the window frame, with the fastener moved to a second position.
Figure 17A:
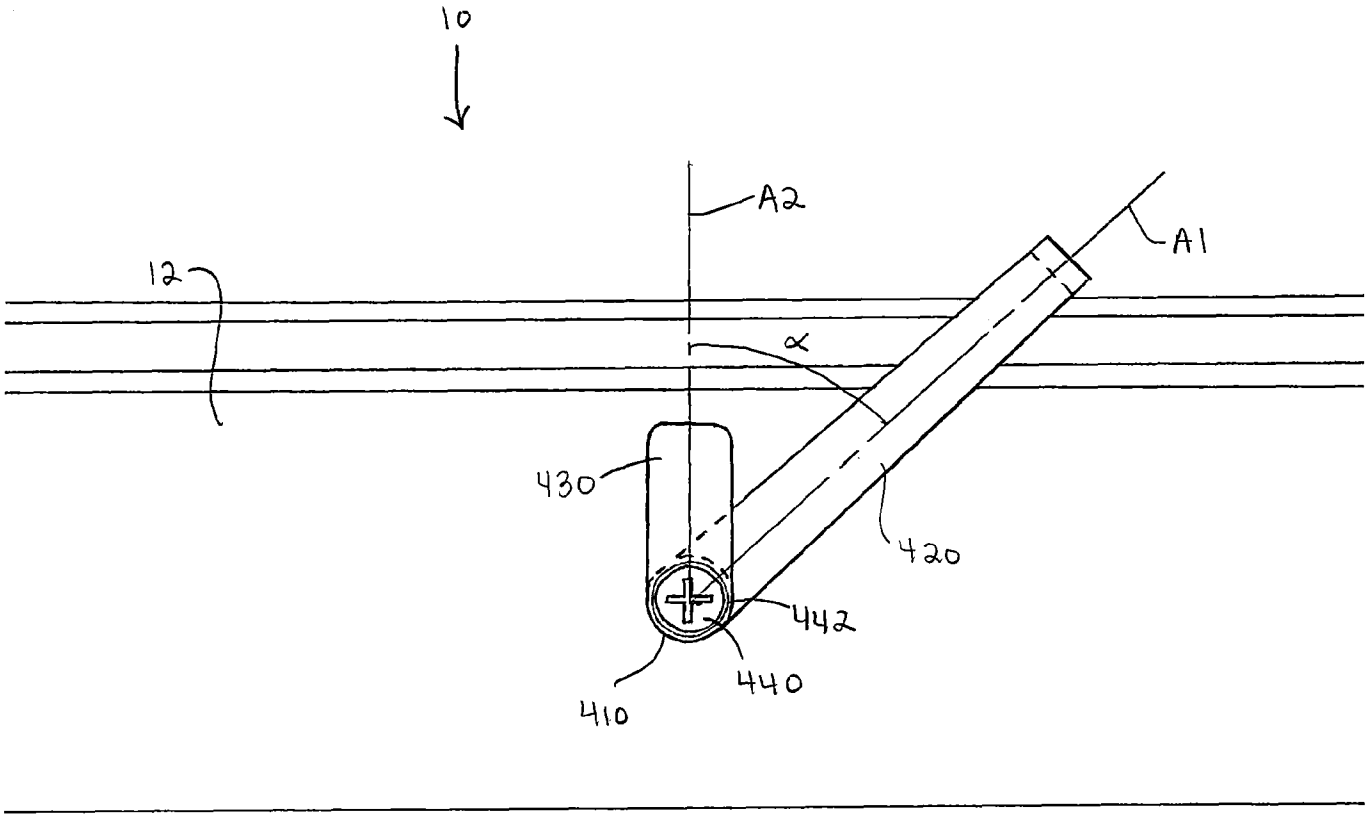
FIG. 17A depicts a bottom view of the fastener of FIG. 13 rotatably secured to the window frame, with the fastener in the first position.
Figure 17B:
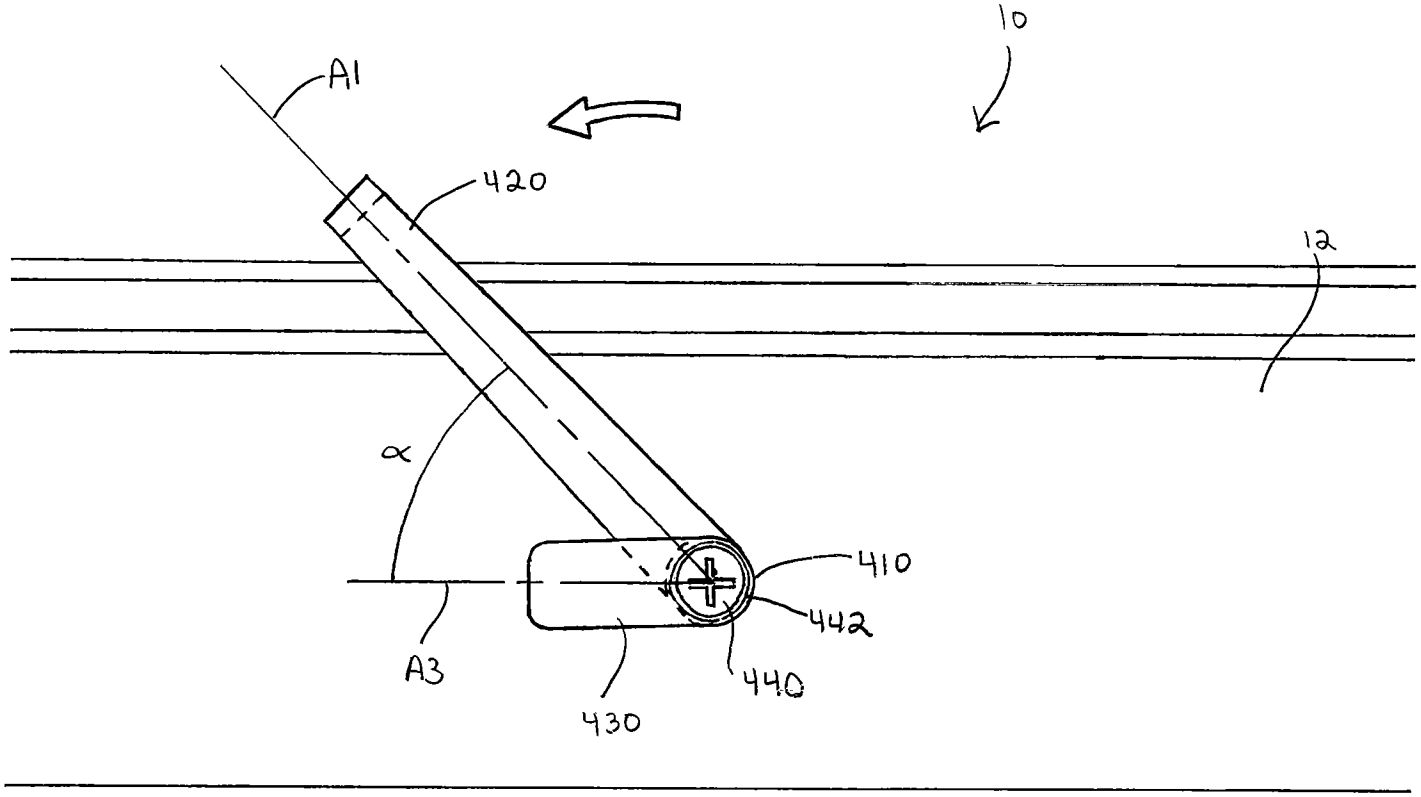
FIG. 17B depicts a bottom view of the fastener of FIG. 13 rotatably secured to the window frame, with the fastener moved to the second position.

As shown in FIGS. 16A-17B, the fastener (400) is secured to the interior surface (12) of the window frame (10) by the screw (440). A washer (442) is positioned between a head of the screw (440) and the cylindrical body (410) of the fastener (400) to provide for rotation of the fastener (400). With the fastener (400) secured to the interior surface (12) of the window frame (10), the lever arm (420) extends beyond the window frame (10) such that a user may easily engage the paddle (422) of the lever arm (420) to thereby rotate the fastener (400). FIGS. 16A and 17A, show the fastener (400) in the unlocked position. As best seen in FIG. 17A, in the unlocked positioned, the locking member (430) is oriented substantially perpendicular to the window frame (10). As will be discussed in more detail below, in the unlocked position, the fastener (400) is capable of receiving the bracket (450). FIGS. 16B and 17B, show the fastener (400) having been rotated into the locked position by rotation of the lever arm (420). As best seen in FIG. 17B, in the locked positioned, the locking member (430) is oriented substantially parallel to the window frame (10). As will be discussed in more detail below, in the locked position, fastener (400) is capable of locking the bracket (450) adjacent to the interior surface of the window frame (10).

Figure 18A:
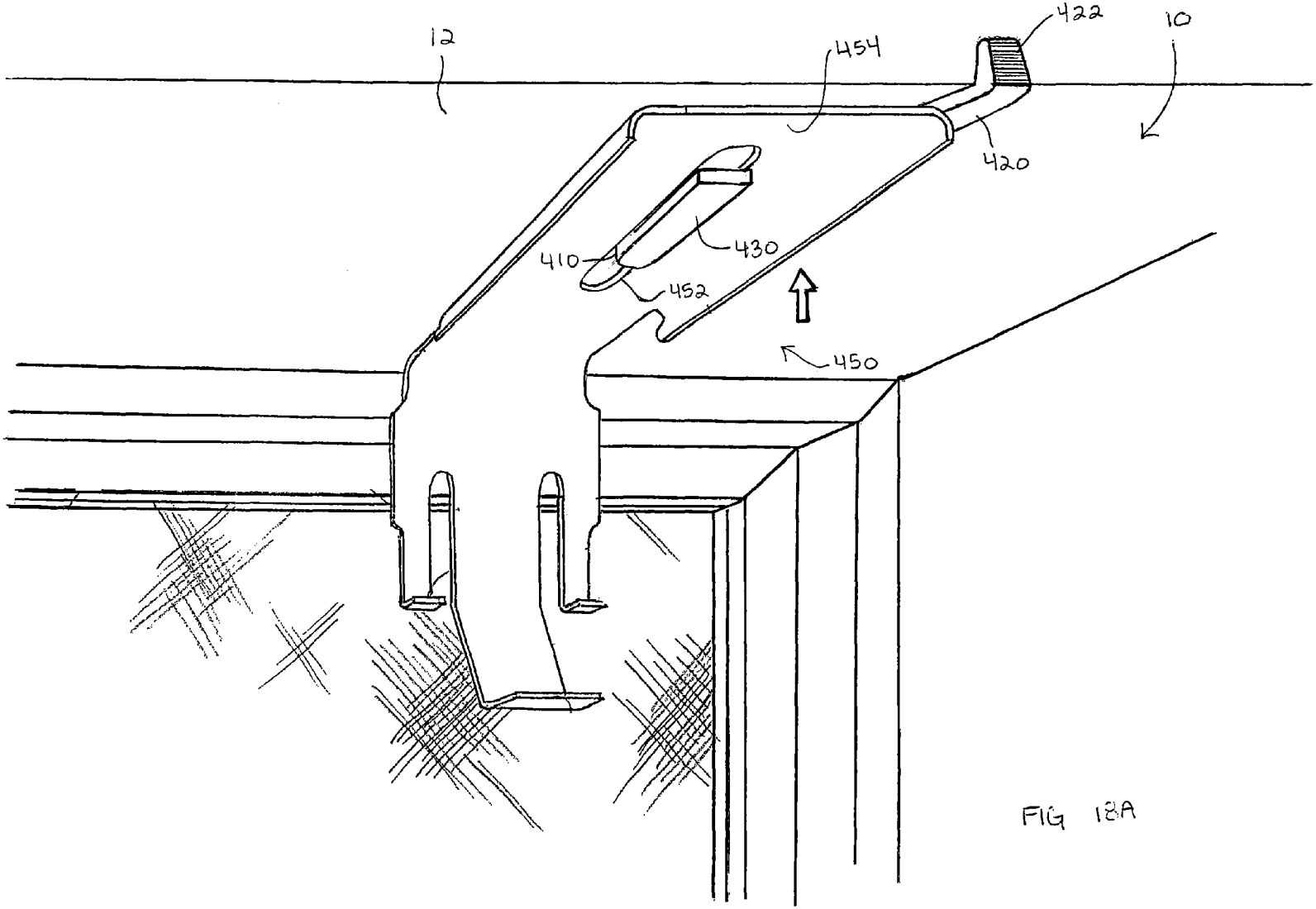
FIG. 18A depicts a perspective view of the fastener of FIG. 13 in the first position, with a bracket disposed adjacent to the window frame.
Figure 18B:
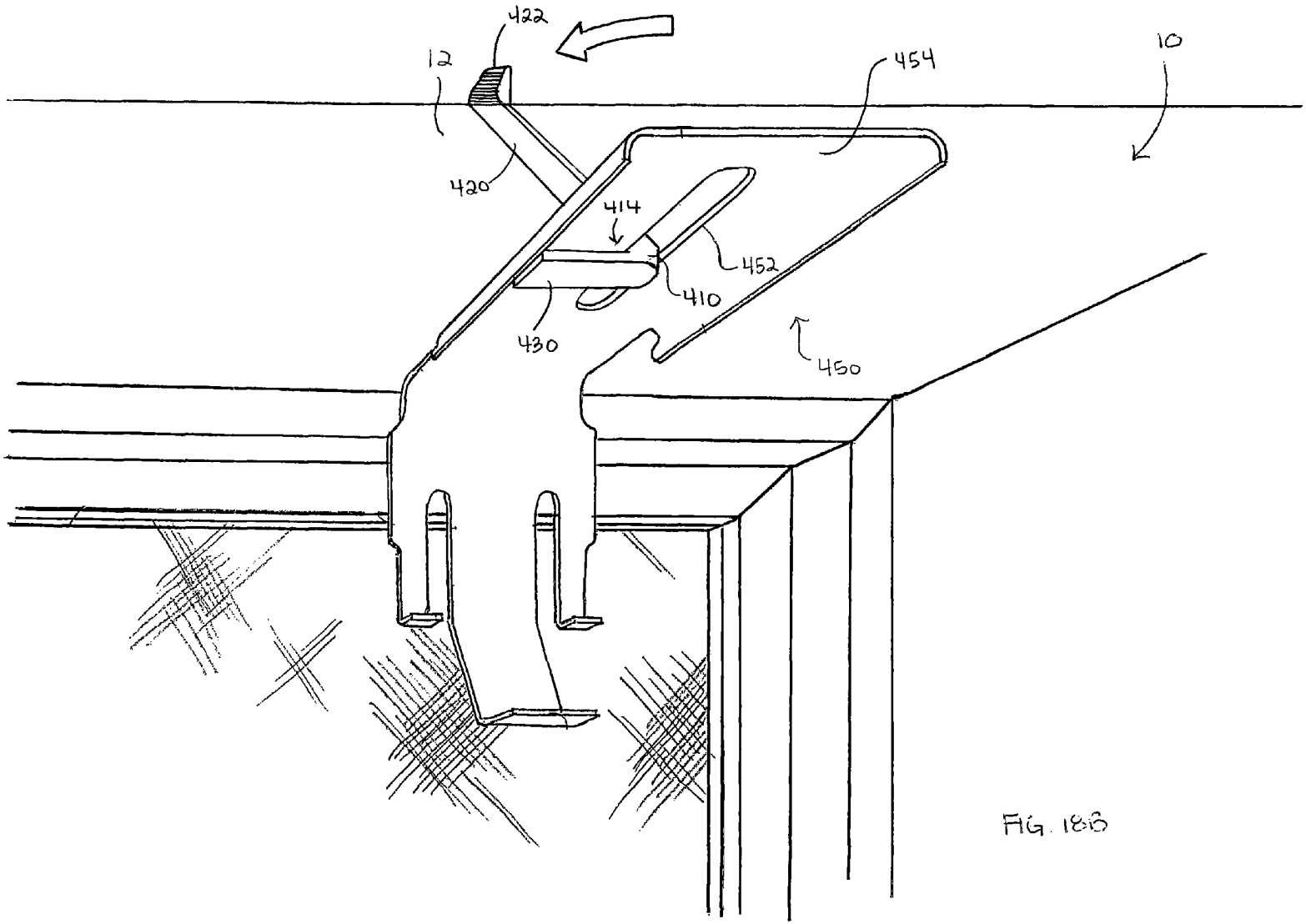
FIG. 18B depicts a perspective view of the fastener of FIG. 13 moved to the second position, with the bracket disposed adjacent to the window frame and locked in place by a portion of the fastener.

FIG. 18A shows the fastener (400) in the unlocked position. The bracket (450) of the present example is configured to operate substantially similar to the bracket (100) discussed above except for the differences discussed below. For instance, the bracket (450) is configured to selectively secure the headrail of blinds (20) to the interior surface (12) of the window frame (10). The bracket (450) is configured such that it is not capable of bending. The bracket (450) includes an elongate opening (452) which passes through a flat portion (454) of bracket (450). The locking member (430) is configured to pass through the elongate opening (452) such that the bracket may be disposed adjacent to the interior surface (12) of the window frame (10). When the bracket (450) is disposed adjacent to the interior surface (12) of the window frame (10), the cylindrical body (410) is rotatably positioned within the elongate opening (452). Furthermore, when the bracket (450) is disposed adjacent to the interior surface (12) of the window frame (10), the lever arm (420) is positioned between the bracket (450) and the interior surface (12) of the window frame (10). Thus, it should be understood that, when the bracket (450) is disposed adjacent to the interior surface (12) of the window frame (10), the lever arm (420) is positioned above the flat portion (454) of bracket (450), the locking member (430) is positioned below the flat portion (454) of bracket (450), and a portion of the cylindrical body (410) is positioned within the elongate opening (452). As best seen in FIG. 15, a vertical space (414) is defined between the lever arm (420) and the locking member (430). It should be understood that this vertical space (414) is configured such that the vertical space (414) measures substantially similar to a height of the flat potion (454) of the bracket (450). FIG. 18B shows the fastener (400) rotated into the locked position by rotation of the lever arm (420). In the locked position, the locking member (430) secures the bracket (450) to the interior surface (12) of the window frame (10).

It should be understood that although the headrail of blinds (20) of the present example has been omitted for the sake of clarity, bracket (450) may be secured and/or removed from the window frame (10) by fastener (400) while the bracket (450) is secured to the headrail of blinds (20). It should further be understood that, with bracket (450) secured to the headrail of blinds (20), the locking member (430) of fastener would rotate within the channel (22) formed in the upper surface of the headrail of blinds (20) such that the fastener (400) may be rotated from the locked position to the unlocked position and vice versa.

It should further be understood that, although the fastener (400) is discussed as being configured to selectively secure the bracket (450) to the interior surface (12) of the window frame (10), the fastener (400) may be used to selectively secure any of the brackets (100, 200, 300) discussed above to the interior surface (12) of the window frame (10). Furthermore, it should be understood that the headrail of blinds (20) may include integral slots such that the headrail of blinds (20) may be secured to the window frame (10) via the fastener (400) without the need for the bracket (450) in the manner described above.

V. Second Rotatable Fastener

Figure 19:
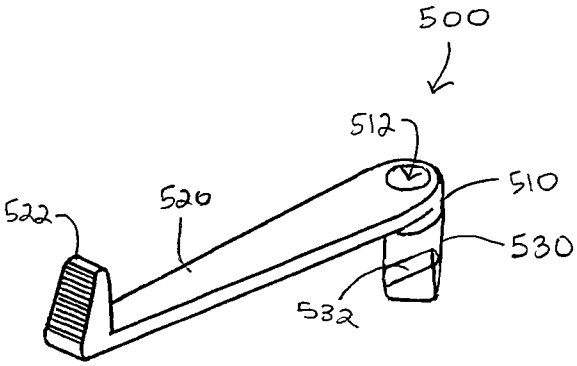
FIG. 19 depicts a perspective view of an alternative fastener constructed in accordance with the techniques of the present disclosure.
Figure 20:
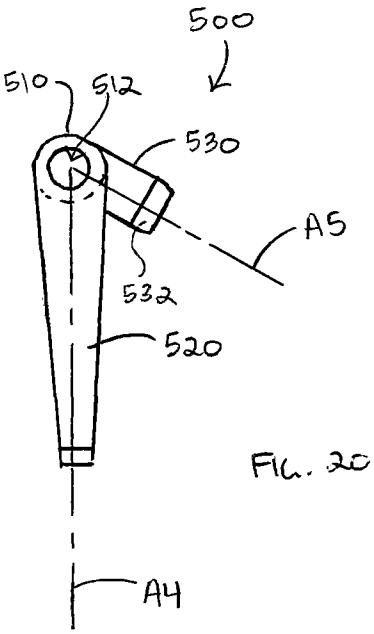
FIG. 20 depicts a top view of the fastener of FIG. 19.
Figure 21:
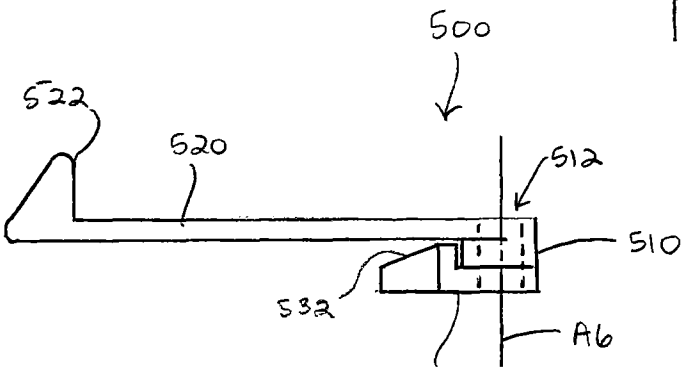
FIG. 21 depicts a side elevational view of the fastener of FIG. 19.

FIGS. 19-21 show an alternative fastener (500) operable for use in a window system as will be described in greater detail below. Fastener (500) is operable to allow a user to selectively remove and/or secure the bracket (450), whether secured to the headrail of blinds (20), to the window frame (10) without requiring removal of a screw (not shown), which secures the bracket to the window frame (10). Fastener (500) is configured to operate substantially similar to fastener (400) discussed above except for the differences discussed below. In particular, fastener (500) is configured to rotate between a locked position and an unlocked position to thereby secure the bracket (450) to the interior surface (12) of the window frame (10).

The fastener (500) comprises a cylindrical body (510), a lever arm (520), and a locking member (530). The lever arm (520) and the locking member (530) extend form the cylindrical body (510). As best seen in FIG. 20, the lever arm (520) extends from the cylindrical body (510) along a first axis (A4), and the locking member (530) extends from the cylindrical body (510) along a second axis (A5). The first axis (A4) and the second axis (A2) are oriented such that the first axis (A4) and the second axis (A5) define an angle (α) between them. For instance, the angle (α) may be 45°; it should be understood however, that any appropriate angle may be used. A cylindrical opening (512) passes completely through the cylindrical body (510) along a third axis (A6). A screw passes through the opening (512) to rotatably secure the fastener (500) to the interior surface (12) of the window frame (10). The lever arm (520) includes a paddle (522) positioned at an end of the lever arm (520) opposite of the cylindrical body (510). A user engages the paddle (522) of the lever arm (520) to thereby rotate the fastener (500) about the third axis (A6) from an unlocked position to a locked position.

The locking member (530) includes a ramp (532) positioned at an end of the locking member (530) opposite of the cylindrical body (510). The ramp (532) is oriented such that as the fastener (500) is rotated toward the locked position, the ramp (532) will increasingly apply force to the bottom surface of the flat portion (454) of the bracket (450) to thereby increasingly compress the flat portion (454) of the bracket (450). It should be understood that, locking member (530) may be flexible such that as more force is applied to the bottom surface of the flat portion (454) of the bracket (450), the locking member (530) will flex.

It should be understood that, although the fastener (500) is discussed as being configured to selectively secure the bracket (450) to the interior surface (12) of the window frame (10), the fastener (500) may be used to selectively secure any of the brackets (100, 200, 300) discussed above to the interior surface (12) of the window frame (10). Furthermore, it should be understood that the headrail of blinds (20) may include integral slots such that the headrail of blinds (20) may be secured to the window frame (10) via the fastener (500) without the need for the bracket (450) in the manner described above.

The foregoing description of embodiments of the invention have been presented for purposes of illustration and description. It is not intended to be exhaustive or to limit the invention to the precise embodiments disclosed. Obvious modifications or variations are possible in light of the above teachings. The embodiments were chosen and described in order to best illustrate the principles of the innovation and its practical application to thereby enable one of ordinary skill in the art to best utilize the innovation in various embodiments and with various modifications as are suited to the particular use contemplated. Although only a limited number of embodiments of the innovation are explained in detail, it is to be understood that the innovation is not limited in its scope to the details of construction and arrangement of components set forth in the preceding description or illustrated in the drawings. The innovation is capable of other embodiments and of being practiced or carried out in various ways. Also specific terminology was used for the sake of clarity. It is to be understood that each specific term includes all technical equivalents which operate in a similar manner to accomplish a similar purpose. It is intended that the scope of the invention be defined by the claims submitted herewith.

We claim:

1. A window system comprising:

(a) a window frame;

(b) a window screen, wherein the window screen is selectively removable from the window system;

(c) blinds, wherein the blinds comprise a headrail; and (d) at least one bracket configured to selectively couple the blinds to the window frame, the at least one bracket comprising:

(i) a first member, wherein the first member is configured to engage the headrail, wherein the at least one bracket is securable to the window frame only through the first member, and (ii) a second member, wherein the second member is configured to engage the headrail, wherein the first member and the second member are coupled to one another by a hinge such that the second member is pivotable relative to the first member about the hinge between a closed position at which the second member extends proximally parallel to and underlying the first member and an open position at which engagement between the first and second members and the headrail is sufficient to secure the at least one bracket to the headrail;

wherein with the at least one bracket secured to the window frame and the second member disposed at the closed position the window screen may be removed from the window system without removing the at least one bracket from the window frame.

2. The window system of claim 1, wherein the first member comprises a flat portion and a pair of flange members projecting from opposite sides of the flat portion, wherein each flange of the pair of flanges is configured to be received within a channel of the headrail of the blinds.

3. The window system of claim 2, wherein each flange of the pair of flanges comprises a tab configured to selectively secure the at least one bracket within the channel of the headrail of the blinds.

4. The window system of claim 2, wherein the flat portion comprises at least one opening operable to receive at least one fastener.

5. The window system of claim 4, wherein the at least one opening comprises a pair of elongate openings oriented along a common axis.

6. The window system of claim 1, wherein the second member comprises a pair of resilient arms and a resilient locking member.

7. The window system of claim 6, wherein each arm of the pair of resilient arms comprises a tab configured to selectively engage and bear against a first surface of the headrail of the blinds, wherein the locking member comprises a tab configured to selectively engage and bear against a second surface of the headrail of the blinds.

8. The window system of claim 1, wherein the first member and second member each comprise a pair of interlocking knuckles.

9. The window system of claim 1, wherein the at least one bracket further comprises a biasing feature configured to bias the at least one bracket toward the open position or the closed position.

10. The window system of claim 9, wherein the biasing feature comprises a torsion spring.

11. The window system of claim 1, wherein the at least one bracket comprises a locking feature configured to selectively lock the at least one bracket in the closed position.

12. The window system of claim 11, wherein the locking feature comprises a resilient locking arm.

* * * * *